US012385260B2

(12) United States Patent
Cappelle

(10) Patent No.: US 12,385,260 B2
(45) **Date of Patent: *Aug. 12, 2025**

(54) FLOOR COVERING, FLOOR ELEMENT AND METHOD FOR MANUFACTURING FLOOR ELEMENTS

(71) Applicant: UNILIN, BV, Wielsbeke (BE)

(72) Inventor: Mark Cappelle, Staden (BE)

(73) Assignee: UNILIN, BV, Wielsbeke (BE)

( * ) Notice: Subject to any disclaimer, the term of this patent is extended or adjusted under 35 U.S.C. 154(b) by 0 days.

This patent is subject to a terminal disclaimer.

(21) Appl. No.: 18/435,188

(22) Filed: Feb. 7, 2024

(65) Prior Publication Data

US 2024/0175271 A1 May 30, 2024

Related U.S. Application Data

(63) Continuation of application No. 18/169,498, filed on Feb. 15, 2023, now Pat. No. 11,933,055, which is a (Continued)

(30) Foreign Application Priority Data

Jun. 2, 2006 (BE) ..... 2006/0309

(51) Int. Cl.
*E04F 15/00* (2006.01)
*E04F 15/02* (2006.01)
(Continued)

(52) U.S. Cl.
CPC ..... *E04F 15/02038* (2013.01); *E04F 15/02* (2013.01); *E04F 15/02033* (2013.01); (Continued)

(58) Field of Classification Search
CPC ..... E04F 15/02033; E04F 15/02038; E04F 15/107; E04F 15/102; E04F 2201/042; (Continued)

(56) References Cited

U.S. PATENT DOCUMENTS 124,228 A 3/1872 Stuart
1,194,636 A 8/1916 Joy
(Continued)

FOREIGN PATENT DOCUMENTS

BE 1017157 A3 3/2008
CA 991 373 A1 6/1976
(Continued)

OTHER PUBLICATIONS

Schreiben LG Düsseldorf, Sep. 26, 2018, 7 pages.
(Continued)

*Primary Examiner* — Chi Q Nguyen
(74) *Attorney, Agent, or Firm* — Workman Nydegger

(57) ABSTRACT

A floor covering, made of floor elements, which, at least at two opposite sides, includes a male coupling part and a female coupling part, which allow that two of such floor elements to be interconnected by pushing one of these floor elements with the associated male coupling part, by a downward movement, home into the female coupling part of the other floor element. At least one of the coupling parts, either the male coupling part or the female coupling part, is made as least partially in a filled synthetic material composite, such as extruded wood.

20 Claims, 14 Drawing Sheets

Related U.S. Application Data continuation of application No. 17/195,876, filed on Mar. 9, 2021, now Pat. No. 11,680,414, which is a continuation of application No. 15/930,629, filed on May 13, 2020, now Pat. No. 10,975,578, which is a continuation of application No. 16/670,722, filed on Oct. 31, 2019, now Pat. No. 10,745,921, which is a continuation of application No. 16/510,433, filed on Jul. 12, 2019, now Pat. No. 10,519,674, which is a continuation of application No. 16/160,120, filed on Oct. 15, 2018, now Pat. No. 10,358,831, which is a continuation of application No. 15/866,932, filed on Jan. 10, 2018, now Pat. No. 10,125,499, which is a continuation of application No. 15/623,484, filed on Jun. 15, 2017, now Pat. No. 9,890,542, which is a continuation of application No. 15/342,490, filed on Nov. 3, 2016, now Pat. No. 9,695,599, which is a continuation of application No. 15/151,106, filed on May 10, 2016, now Pat. No. 9,487,957, which is a continuation of application No. 14/672,444, filed on Mar. 30, 2015, now Pat. No. 9,366,037, which is a continuation of application No. 12/303,044, filed as application No. PCT/IB2007/000862 on Mar. 22, 2007, now Pat. No. 8,991,055.

(51) Int. Cl.
*E04F 15/04* (2006.01)
*E04F 15/10* (2006.01)

(52) U.S. Cl.
CPC ..... *E04F 15/045* (2013.01); *E04F 15/048* (2013.01); *E04F 15/102* (2013.01); *E04F 2201/0115* (2013.01); *E04F 2201/013* (2013.01); *E04F 2201/0138* (2013.01); *E04F 2201/0146* (2013.01); *E04F 2201/0153* (2013.01); *E04F 2201/0161* (2013.01); *E04F 2201/023* (2013.01); *E04F 2201/026* (2013.01); *E04F 2201/041* (2013.01); *E04F 2201/043* (2013.01); *E04F 2201/049* (2013.01); *E04F 2201/0529* (2013.01); *Y10T 29/49623* (2015.01); *Y10T 29/49629* (2015.01)

(58) Field of Classification Search
CPC ..... E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138; E04F 15/02; E04F 2201/0115; E04F 2201/026; E04F 2201/011
See application file for complete search history.

(56) References Cited

U.S. PATENT DOCUMENTS 1,723,306 A 8/1929 Sipe
1,743,492 A 1/1930 Sipe
1,809,393 A 6/1931 Rockwell
1,902,716 A 3/1933 Newton
1,971,067 A 8/1934 Fess
2,026,511 A 12/1935 Storm
2,204,675 A 6/1940 Grunert
2,596,280 A 5/1952 Nystrom
2,732,706 A 1/1956 Friedman
2,740,167 A 4/1956 Rowley
2,863,185 A 12/1958 Riedi
2,865,058 A 12/1958 Andersson et al.
3,023,681 A 3/1962 Worson
3,077,703 A 2/1963 Bergstrom
3,173,804 A 3/1965 Standfuss
3,271,787 A 9/1966 Clary
3,325,585 A 6/1967 Brenneman
3,378,958 A 4/1968 Parks et al.
3,387,422 A 6/1968 Wanzer
3,396,640 A 8/1968 Fujihara
3,434,861 A 3/1969 Luc
3,512,324 A 5/1970 Reed
3,517,927 A 6/1970 Kennel
3,526,071 A 9/1970 Watanabe
3,535,844 A 10/1970 Glaros
3,554,827 A 1/1971 Yamagishi
3,572,224 A 3/1971 Perry
3,579,941 A 5/1971 Tibbals
3,720,027 A 3/1973 Christensen
3,731,445 A 5/1973 Hoffmann et al.
3,741,851 A 6/1973 Erb et al.
3,742,669 A 7/1973 Mansfeld
3,760,547 A 9/1973 Brenneman
3,778,954 A 12/1973 Meserole
3,786,608 A 1/1974 Boettcher
3,810,774 A 5/1974 Pittman
3,811,915 A 5/1974 Burrell et al.
3,849,235 A 11/1974 Gwynne
3,853,685 A 12/1974 Friedrich et al.
3,905,849 A 9/1975 Bomboire
3,919,820 A 11/1975 Green
3,950,915 A 4/1976 Cole
3,980,173 A 9/1976 Riggs
4,030,852 A 6/1977 Hein
4,050,409 A 9/1977 Duchenaud et al.
4,064,571 A 12/1977 Phipps
4,080,086 A 3/1978 Watson
4,082,129 A 4/1978 Morelock
4,097,635 A 6/1978 Sanz Hernandez et al.
4,100,710 A 7/1978 Kowallik
4,107,892 A 8/1978 Bellem
4,113,399 A 9/1978 Hansen, Sr.
4,169,688 A 10/1979 Toshio
4,196,554 A 4/1980 Anderson et al.
4,225,374 A 9/1980 Kaufmann
4,227,430 A 10/1980 Jansson et al.
4,233,343 A 11/1980 Barker et al.
4,299,070 A 11/1981 Oltmanns et al.
4,304,083 A 12/1981 Anderson
4,312,686 A 1/1982 Smith et al.
4,379,198 A 4/1983 Jaeschke et al.
4,396,566 A 8/1983 Brinkmann et al.
4,397,896 A 8/1983 Moran
4,400,862 A 8/1983 Ignell
4,426,820 A 1/1984 Terbrack et al.
4,512,131 A 4/1985 Laramore
4,599,841 A 7/1986 Haid
4,614,680 A 9/1986 Fry et al.
4,648,165 A 3/1987 Whitehorne
4,690,434 A 9/1987 Schmidt
4,724,187 A 2/1988 Ungar et al.
4,819,932 A 4/1989 Trotter, Jr.
4,948,653 A 8/1990 Dinter et al.
5,007,222 A 4/1991 Raymond
5,071,282 A 12/1991 Brown
5,077,112 A 12/1991 Hensel et al.
5,082,495 A 1/1992 Iijima
5,109,898 A 5/1992 Schacht
5,112,671 A 5/1992 Diamond et al.
5,135,597 A 8/1992 Barker
5,148,850 A 9/1992 Urbanick
5,173,012 A 12/1992 Ortwein et al.
5,182,892 A 2/1993 Chase
5,247,773 A 9/1993 Weir
5,261,508 A 11/1993 Kikuchi
5,295,341 A 3/1994 Kajiwara
5,344,700 A 9/1994 Mcgath et al.
5,348,778 A 9/1994 Knipp et al.
5,437,934 A 8/1995 Witt et al.
5,465,546 A 11/1995 Buse
5,506,031 A 4/1996 Spain et al.
5,516,472 A 5/1996 Laver
5,548,937 A 8/1996 Shimonohara

(56) References Cited

U.S. PATENT DOCUMENTS

| | | | |
|---|---|---|---|
| 5,560,797 | A | 10/1996 | Burt et al. |
| 5,598,682 | A | 2/1997 | Haughian |
| 5,618,602 | A | 4/1997 | Nelson |
| 5,634,309 | A | 6/1997 | Polen |
| 5,694,730 | A | 12/1997 | Del Rincon et al. |
| 5,706,621 | A | 1/1998 | Pervan |
| 5,755,068 | A | 5/1998 | Ormiston |
| 5,836,128 | A | 11/1998 | Groh et al. |
| 5,860,267 | A | 1/1999 | Pervan |
| 5,863,632 | A | 1/1999 | Bisker |
| 5,899,038 | A | 5/1999 | Stroppiana |
| 5,916,662 | A | 6/1999 | Schmidt |
| 5,950,389 | A | 9/1999 | Porter |
| 5,952,076 | A | 9/1999 | Foster |
| 5,988,503 | A | 11/1999 | Kuo |
| 6,006,486 | A | 12/1999 | Moriau et al. |
| 6,023,907 | A | 2/2000 | Pervan |
| 6,052,960 | A | 4/2000 | Yonemura |
| 6,065,262 | A | 5/2000 | Motta |
| 6,173,548 | B1 | 1/2001 | Hamar et al. |
| 6,182,410 | B1 | 2/2001 | Pervan |
| 6,203,653 | B1 | 3/2001 | Seidner |
| 6,216,409 | B1 | 4/2001 | Roy et al. |
| 6,254,301 | B1 | 7/2001 | Hatch |
| 6,256,959 | B1 | 7/2001 | Palmersten |
| 6,272,437 | B1 | 8/2001 | Woods et al. |
| 6,295,779 | B1 | 10/2001 | Canfield |
| 6,296,732 | B1 | 10/2001 | Enlow et al. |
| 6,306,318 | B1 | 10/2001 | Ricciardelli et al. |
| 6,314,701 | B1 | 11/2001 | Meyerson |
| 6,324,803 | B1 | 12/2001 | Pervan |
| 6,333,094 | B1 | 12/2001 | Schneider et al. |
| 6,345,481 | B1 | 2/2002 | Nelson |
| 6,358,352 | B1 | 3/2002 | Schmidt |
| 6,363,677 | B1 | 4/2002 | Chen et al. |
| 6,385,936 | B1 | 5/2002 | Schneider |
| 6,418,683 | B1 | 7/2002 | Martensson et al. |
| 6,428,871 | B1 | 8/2002 | Cozzolino |
| 6,444,075 | B1 | 9/2002 | Schneider et al. |
| 6,446,413 | B1 | 9/2002 | Gruber |
| 6,450,235 | B1 | 9/2002 | Lee |
| 6,465,046 | B1 | 10/2002 | Hansson et al. |
| 6,477,948 | B1 | 11/2002 | Nissing et al. |
| 6,490,836 | B1 | 12/2002 | Moriau et al. |
| 6,505,452 | B1 | 1/2003 | Hannig et al. |
| 6,516,579 | B1 | 2/2003 | Pervan |
| 6,536,178 | B1 | 3/2003 | Palsson et al. |
| 6,550,206 | B2 | 4/2003 | Lee |
| 6,553,724 | B1 | 4/2003 | Bigler |
| 6,576,079 | B1 | 6/2003 | Kai |
| 6,591,568 | B1 | 7/2003 | Palsson |
| 6,601,359 | B2 | 8/2003 | Olofsson |
| 6,617,009 | B1 | 9/2003 | Chen et al. |
| 6,647,689 | B2 | 11/2003 | Pletzer et al. |
| 6,647,690 | B1 | 11/2003 | Martensson |
| 6,651,400 | B1 | 11/2003 | Murphy |
| 6,681,820 | B2 | 1/2004 | Olofsson |
| 6,729,091 | B1 | 5/2004 | Martensson |
| 6,763,643 | B1 | 7/2004 | Martensson |
| 6,769,219 | B2 | 8/2004 | Schwitte et al. |
| 6,772,568 | B2 | 8/2004 | Thiers et al. |
| 6,802,166 | B1 | 10/2004 | Gerhard |
| 6,804,926 | B1 | 10/2004 | Eisermann |
| 6,854,235 | B2 | 2/2005 | Martensson |
| 6,862,857 | B2 | 3/2005 | Tychsen |
| 6,865,855 | B2 | 3/2005 | Knauseder |
| 6,874,291 | B1 | 4/2005 | Weber |
| 6,874,292 | B2 | 4/2005 | Moriau et al. |
| 6,880,307 | B2 | 4/2005 | Schwitte et al. |
| 6,928,779 | B2 | 8/2005 | Moriau et al. |
| 6,931,811 | B2 | 8/2005 | Thiers |
| 6,933,043 | B1 | 8/2005 | Son et al. |
| 6,955,020 | B2 | 10/2005 | Moriau et al. |
| 6,979,487 | B2 | 12/2005 | Scarbrough et al. |
| 6,986,934 | B2 | 1/2006 | Chen et al. |
| 6,991,830 | B1 | 1/2006 | Hansson et al. |
| 6,993,877 | B2 | 2/2006 | Moriau et al. |
| 7,021,019 | B2 | 4/2006 | Kanuseder |
| 7,040,068 | B2 | 5/2006 | Moriau et al. |
| 7,051,486 | B2 | 5/2006 | Pervan |
| 7,149,633 | B2 | 12/2006 | Woods et al. |
| 7,152,383 | B1 | 12/2006 | Wilkinson, Jr. et al. |
| 7,169,460 | B1 | 1/2007 | Chen et al. |
| 7,188,456 | B2 | 3/2007 | Knauseder |
| 7,211,310 | B2 | 5/2007 | Chen et al. |
| 7,219,392 | B2 | 5/2007 | Mullet et al. |
| 7,243,469 | B2 | 7/2007 | Miller et al. |
| 7,251,916 | B2 | 8/2007 | Konzelmann et al. |
| 7,261,947 | B2 | 8/2007 | Reichwein et al. |
| 7,328,536 | B2 | 2/2008 | Moriau et al. |
| 7,337,588 | B1 | 3/2008 | Moebus |
| 7,343,717 | B2 | 3/2008 | Thiers et al. |
| 7,377,081 | B2 | 5/2008 | Ruhdorfer |
| 7,419,717 | B2 | 9/2008 | Chen et al. |
| 7,451,578 | B2 | 11/2008 | Hannig |
| 7,454,875 | B2 | 11/2008 | Pervan et al. |
| 7,467,499 | B2 | 12/2008 | Moriau et al. |
| 7,516,588 | B2 | 4/2009 | Pervan |
| 7,533,500 | B2 | 5/2009 | Morton et al. |
| 7,544,423 | B2 | 6/2009 | Horton |
| 7,552,568 | B2 | 6/2009 | Palsson et al. |
| 7,556,849 | B2 | 7/2009 | Thompson et al. |
| 7,568,322 | B2 | 8/2009 | Pervan |
| 7,584,583 | B2 | 9/2009 | Bergelin et al. |
| 7,596,920 | B2 | 10/2009 | Konstanczak |
| 7,603,826 | B1 | 10/2009 | Moebus |
| 7,614,197 | B2 | 11/2009 | Nelson |
| 7,617,645 | B2 | 11/2009 | Moriau et al. |
| 7,617,651 | B2 | 11/2009 | Grafenauer |
| 7,621,092 | B2 | 11/2009 | Groeke et al. |
| 7,621,094 | B2 | 11/2009 | Moriau et al. |
| 7,634,886 | B2 | 11/2009 | Moriau et al. |
| 7,634,887 | B2 | 11/2009 | Moriau et al. |
| 7,634,884 | B2 | 12/2009 | Pervan et al. |
| 7,637,066 | B2 | 12/2009 | Moriau et al. |
| 7,637,067 | B2 | 12/2009 | Moriau et al. |
| 7,637,068 | B2 | 12/2009 | Pervan |
| 7,640,708 | B2 | 1/2010 | Moriau et al. |
| 7,644,554 | B2 | 1/2010 | Moriau et al. |
| 7,644,555 | B2 | 1/2010 | Moriau et al. |
| 7,644,557 | B2 | 1/2010 | Moriau et al. |
| 7,647,741 | B2 | 1/2010 | Moriau et al. |
| 7,647,743 | B2 | 1/2010 | Moriau et al. |
| 7,650,727 | B2 | 1/2010 | Moriau et al. |
| 7,650,728 | B2 | 1/2010 | Moriau et al. |
| 7,654,054 | B2 | 2/2010 | Moriau et al. |
| 7,658,048 | B2 | 2/2010 | Moriau et al. |
| 7,661,238 | B2 | 2/2010 | Moriau et al. |
| 7,665,265 | B2 | 2/2010 | Moriau et al. |
| 7,665,266 | B2 | 2/2010 | Moriau et al. |
| 7,665,267 | B2 | 2/2010 | Moriau et al. |
| 7,665,268 | B2 | 2/2010 | Moriau et al. |
| 7,669,376 | B2 | 3/2010 | Moriau et al. |
| 7,669,377 | B2 | 3/2010 | Moriau et al. |
| 7,673,431 | B2 | 3/2010 | Moriau et al. |
| 7,677,005 | B2 | 3/2010 | Pervan |
| 7,677,008 | B2 | 3/2010 | Moriau et al. |
| 7,681,371 | B2 | 3/2010 | Moriau et al. |
| 7,698,868 | B2 | 4/2010 | Moriau et al. |
| 7,698,869 | B2 | 4/2010 | Moriau et al. |
| 7,707,793 | B2 | 5/2010 | Moriau et al. |
| 7,712,280 | B2 | 5/2010 | Moriau et al. |
| 7,721,503 | B2 | 5/2010 | Pervan et al. |
| 7,726,089 | B2 | 6/2010 | Moriau et al. |
| 7,735,288 | B2 | 6/2010 | Moriau et al. |
| 7,757,452 | B2 | 7/2010 | Pervan |
| 7,757,453 | B2 | 7/2010 | Moriau et al. |
| 7,762,035 | B2 | 7/2010 | Cappelle |
| 7,763,345 | B2 | 7/2010 | Chen et al. |
| 7,770,350 | B2 | 8/2010 | Moriau et al. |
| 7,779,597 | B2 | 8/2010 | Thiers et al. |
| 7,802,415 | B2 | 9/2010 | Pervan et al. |
| 7,806,624 | B2 | 10/2010 | Mclean et al. |
| 7,810,297 | B2 | 10/2010 | Moriau et al. |

(56) References Cited

U.S. PATENT DOCUMENTS 7,827,754 B2 11/2010 Moriau et al.
7,827,755 B2 11/2010 Moriau et al.
7,841,145 B2 11/2010 Pervan et al.
7,856,785 B2 12/2010 Pervan
7,866,115 B2 1/2011 Pervan et al.
7,877,956 B2 2/2011 Martensson
7,896,571 B1 3/2011 Hannig et al.
7,918,062 B2 4/2011 Chen
7,980,043 B2 7/2011 Moebus
8,021,741 B2 9/2011 Chen et al.
8,024,904 B2 9/2011 Hannig
8,099,919 B2 1/2012 Garcia
8,153,234 B2 4/2012 Nollet et al.
8,156,705 B2 4/2012 Alford et al.
8,161,701 B2 4/2012 Cappelle et al.
8,166,723 B2 5/2012 Moriau et al.
8,176,698 B2 5/2012 Lewark
8,182,928 B2 5/2012 Horton
8,191,334 B2 6/2012 Braun
8,245,477 B2 8/2012 Pervan
8,272,187 B2 9/2012 Meersseman et al.
8,293,058 B2 10/2012 Pervan et al.
8,365,494 B2 2/2013 Moriau et al.
8,375,672 B2 2/2013 Hannig
8,438,814 B2 5/2013 Thiers et al.
8,596,013 B2 12/2013 Boo
8,615,953 B2 12/2013 Cappelle
8,621,814 B2 1/2014 Cappelle
8,631,625 B2 1/2014 Thiers et al.
8,689,512 B2 4/2014 Pervan
8,726,603 B2 5/2014 Huang
8,789,334 B2 7/2014 Moriau et al.
8,793,958 B2 8/2014 Thiers et al.
8,839,584 B2 9/2014 Sokol
8,904,729 B2 12/2014 Thiers et al.
8,991,055 B2 3/2015 Cappelle
8,997,429 B2 4/2015 Moriau et al.
9,140,010 B2 9/2015 Pervan
9,145,691 B2 9/2015 Cappelle
9,200,460 B2 12/2015 Cappelle
9,216,541 B2 12/2015 Boo et al.
9,290,948 B2 3/2016 Cappelle et al.
9,290,951 B2 3/2016 Moriau et al.
9,314,888 B2 4/2016 Pervan et al.
9,316,002 B2 4/2016 Boo
9,322,183 B2 4/2016 Pervan
9,366,037 B2 6/2016 Cappelle
9,487,957 B2 11/2016 Cappelle
9,695,599 B2 7/2017 Cappelle
9,890,542 B2 2/2018 Cappelle
10,125,499 B2 11/2018 Cappelle
10,358,831 B2 7/2019 Cappelle
10,519,674 B2 12/2019 Cappelle
10,745,921 B2 8/2020 Cappelle
10,975,578 B2 4/2021 Cappelle
10,975,579 B2 4/2021 Cappelle
11,680,414 B2 6/2023 Cappelle
11,933,055 B2 * 3/2024 Cappelle ..... E04F 15/048
12,110,693 B1 * 10/2024 Devos ..... E04F 15/02038
2001/0034991 A1 11/2001 Martensson et al.
2002/0020127 A1 2/2002 Thiers et al.
2002/0025446 A1 2/2002 Chen et al.
2002/0031646 A1 3/2002 Chen et al.
2002/0046527 A1 4/2002 Nelson
2002/0092263 A1 7/2002 Schulte
2002/0136862 A1 9/2002 Dong et al.
2002/0142106 A1 10/2002 Bethune et al.
2002/0170259 A1 11/2002 Ferris
2002/0178674 A1 12/2002 Pervan
2002/0178680 A1 12/2002 Martensson et al.
2002/0189183 A1 12/2002 Ricciardelli
2003/0009971 A1 1/2003 Palmberg
2003/0024199 A1 2/2003 Pervan et al.
2003/0029116 A1 2/2003 Moriau et al.
2003/0029117 A1 2/2003 Moriau et al.
2003/0033777 A1 2/2003 Thiers et al.
2003/0037504 A1 2/2003 Schwitte et al.
2003/0097808 A1 5/2003 Sabatini
2003/0101681 A1 6/2003 Tychsen
2003/0136494 A1 7/2003 Windmoller et al.
2003/0145549 A1 8/2003 Palsson et al.
2003/0159385 A1 8/2003 Thiers
2003/0180091 A1 9/2003 Stridsman
2003/0188504 A1 10/2003 Ralf
2003/0196405 A1 10/2003 Pervan
2003/0224147 A1 12/2003 Maine et al.
2003/0233809 A1 12/2003 Pervan
2003/0236642 A1 12/2003 Timans
2004/0016196 A1 1/2004 Pervan
2004/0016197 A1 1/2004 Ruhdorfer
2004/0026017 A1 2/2004 Taylor et al.
2004/0031227 A1 2/2004 Knauseder
2004/0049999 A1 3/2004 Krieger
2004/0060255 A1 4/2004 Knauseder
2004/0068954 A1 4/2004 Martensson
2004/0071978 A1 4/2004 Hallenbeck et al.
2004/0102120 A1 5/2004 Plusquellec et al.
2004/0107659 A1 6/2004 Glockl
2004/0123548 A1 7/2004 Gimpel et al.
2004/0128934 A1 7/2004 Hecht
2004/0137248 A1 7/2004 Elsasser
2004/0139678 A1 7/2004 Pervan
2004/0146695 A1 7/2004 Hardwick
2004/0161588 A1 8/2004 Mauk et al.
2004/0182036 A1 9/2004 Sjoberg et al.
2004/0191547 A1 9/2004 Oldorff
2004/0200175 A1 10/2004 Weber
2004/0211143 A1 10/2004 Hanning
2004/0211144 A1 10/2004 Stanchfield
2004/0248489 A1 12/2004 Hutchison et al.
2004/0250493 A1 12/2004 Thiers et al.
2004/0255538 A1 12/2004 Ruhdorfer
2004/0261348 A1 12/2004 Vulin
2005/0003160 A1 1/2005 Chen et al.
2005/0025934 A1 2/2005 Thiers
2005/0050827 A1 3/2005 Schitter
2005/0076598 A1 4/2005 Lewark
2005/0144881 A1 7/2005 Tate et al.
2005/0153243 A1 7/2005 Rundle et al.
2005/0160694 A1 7/2005 Pervan
2005/0166514 A1 8/2005 Pervan
2005/0166515 A1 8/2005 Boucke
2005/0192382 A1 9/2005 Maine et al.
2005/0210810 A1 9/2005 Pervan
2005/0221056 A1 10/2005 Schwonke et al.
2005/0235593 A1 10/2005 Hecht
2005/0252130 A1 11/2005 Martensson
2005/0281986 A1 12/2005 Nam
2005/0284075 A1 12/2005 Moriau et al.
2005/0284076 A1 12/2005 Moriau et al.
2006/0005499 A1 1/2006 Moriau et al.
2006/0008630 A1 1/2006 Thiers et al.
2006/0032175 A1 2/2006 Chen et al.
2006/0032177 A1 2/2006 Moriau et al.
2006/0070332 A1 4/2006 Palsson et al.
2006/0070333 A1 4/2006 Pervan
2006/0101769 A1 5/2006 Pervan et al.
2006/0105145 A1 5/2006 Brown
2006/0179773 A1 8/2006 Pervan
2006/0186233 A1 8/2006 Holm et al.
2006/0196138 A1 9/2006 Moriau et al.
2006/0201095 A1 9/2006 Moriau et al.
2006/0204773 A1 9/2006 Kwon et al.
2006/0225370 A1 10/2006 Moriau et al.
2006/0225377 A1 10/2006 Moriau et al.
2006/0236630 A1 10/2006 Moriau et al.
2006/0236631 A1 10/2006 Moriau et al.
2006/0236632 A1 10/2006 Moriau et al.
2006/0236633 A1 10/2006 Moriau et al.
2006/0236634 A1 10/2006 Moriau et al.
2006/0236635 A1 10/2006 Moriau et al.
2006/0236636 A1 10/2006 Moriau et al.
2006/0236637 A1 10/2006 Moriau et al.
2006/0236638 A1 10/2006 Moriau et al.

(56) References Cited

U.S. PATENT DOCUMENTS

| | | | |
|---|---|---|---|
| 2006/0236642 | A1 | 10/2006 | Pervan |
| 2006/0236643 | A1 | 10/2006 | Moriau et al. |
| 2006/0248829 | A1 | 11/2006 | Moriau et al. |
| 2006/0248830 | A1 | 11/2006 | Moriau et al. |
| 2006/0248831 | A1 | 11/2006 | Moriau et al. |
| 2006/0254183 | A1 | 11/2006 | Moriau et al. |
| 2006/0254184 | A1 | 11/2006 | Moriau et al. |
| 2006/0254185 | A1 | 11/2006 | Moriau et al. |
| 2006/0260249 | A1 | 11/2006 | Moriau et al. |
| 2006/0260252 | A1 | 11/2006 | Brice |
| 2006/0260253 | A1 | 11/2006 | Brice |
| 2006/0260254 | A1 | 11/2006 | Pervan |
| 2006/0272263 | A1 | 12/2006 | Moriau et al. |
| 2006/0280870 | A1 | 12/2006 | Halot et al. |
| 2007/0006543 | A1 | 1/2007 | Engstrom |
| 2007/0022694 | A1 | 2/2007 | Chen et al. |
| 2007/0028547 | A1 | 2/2007 | Grafenauer et al. |
| 2007/0039664 | A1 | 2/2007 | Quick |
| 2007/0051064 | A1 | 3/2007 | Thiers |
| 2007/0094978 | A1 | 5/2007 | Svanholm et al. |
| 2007/0094986 | A1 | 5/2007 | Moriau et al. |
| 2007/0094987 | A1 | 5/2007 | Moriau et al. |
| 2007/0107360 | A1 | 5/2007 | Moriau et al. |
| 2007/0107363 | A1 | 5/2007 | Moriau et al. |
| 2007/0130872 | A1 | 6/2007 | Goodwin et al. |
| 2007/0151189 | A1 | 7/2007 | Yang |
| 2007/0175156 | A1 | 8/2007 | Pervan et al. |
| 2007/0175160 | A1 | 8/2007 | Groeke et al. |
| 2007/0193178 | A1 | 8/2007 | Groeke et al. |
| 2007/0251188 | A1 | 11/2007 | Moriau et al. |
| 2008/0000186 | A1 | 1/2008 | Pervan et al. |
| 2008/0005999 | A1 | 1/2008 | Pervan |
| 2008/0010928 | A1 | 1/2008 | Moriau et al. |
| 2008/0010929 | A1 | 1/2008 | Moriau et al. |
| 2008/0010931 | A1 | 1/2008 | Pervan et al. |
| 2008/0010937 | A1 | 1/2008 | Pervan et al. |
| 2008/0028707 | A1 | 2/2008 | Pervan |
| 2008/0029926 | A1 | 2/2008 | Steinwender et al. |
| 2008/0034701 | A1 | 2/2008 | Pervan |
| 2008/0034708 | A1 | 2/2008 | Pervan |
| 2008/0041008 | A1 | 2/2008 | Pervan |
| 2008/0053027 | A1 | 3/2008 | Moriau et al. |
| 2008/0053028 | A1 | 3/2008 | Moriau et al. |
| 2008/0060308 | A1 | 3/2008 | Pervan |
| 2008/0060309 | A1 | 3/2008 | Moriau et al. |
| 2008/0060310 | A1 | 3/2008 | Moriau et al. |
| 2008/0060311 | A1 | 3/2008 | Moriau et al. |
| 2008/0066415 | A1 | 3/2008 | Pervan et al. |
| 2008/0066416 | A1 | 3/2008 | Moriau et al. |
| 2008/0104921 | A1 | 5/2008 | Pervan et al. |
| 2008/0110125 | A1 | 5/2008 | Pervan |
| 2008/0134607 | A1 | 6/2008 | Pervan et al. |
| 2008/0134613 | A1 | 6/2008 | Pervan |
| 2008/0134614 | A1 | 6/2008 | Pervan et al. |
| 2008/0138560 | A1 | 6/2008 | Windmoller |
| 2008/0168736 | A1 | 7/2008 | Pervan |
| 2008/0168737 | A1 | 7/2008 | Pervan |
| 2008/0172856 | A1 | 7/2008 | Brouckaert et al. |
| 2008/0216920 | A1 | 9/2008 | Pervan |
| 2008/0261019 | A1 | 10/2008 | Shen et al. |
| 2008/0295432 | A1 | 12/2008 | Pervan et al. |
| 2008/0301945 | A1 | 12/2008 | Gibson et al. |
| 2008/0305312 | A1 | 12/2008 | Kim et al. |
| 2008/0311355 | A1 | 12/2008 | Chen et al. |
| 2009/0019801 | A1 | 1/2009 | Coghlan et al. |
| 2009/0031662 | A1 | 2/2009 | Chen et al. |
| 2009/0078129 | A1 | 3/2009 | Cappelle et al. |
| 2009/0151291 | A1 | 6/2009 | Pervan |
| 2009/0193748 | A1 | 8/2009 | Boo et al. |
| 2009/0249733 | A1 | 10/2009 | Moebus |
| 2009/0260307 | A1 | 10/2009 | Thiers |
| 2009/0260313 | A1 | 10/2009 | Segaert |
| 2010/0043333 | A1 | 2/2010 | Hannig |
| 2010/0170189 | A1 | 7/2010 | Schulte |
| 2010/0300031 | A1 | 12/2010 | Pervan et al. |
| 2010/0319290 | A1 | 12/2010 | Pervan et al. |
| 2010/0319291 | A1 | 12/2010 | Pervan et al. |
| 2010/0319292 | A1 | 12/2010 | Moriau et al. |
| 2011/0023405 | A1 | 2/2011 | Moriau et al. |
| 2011/0030303 | A1 | 2/2011 | Pervan et al. |
| 2011/0088344 | A1 | 4/2011 | Pervan et al. |
| 2011/0088345 | A1 | 4/2011 | Pervan et al. |
| 2011/0154665 | A1 | 6/2011 | Pervan et al. |
| 2011/0167750 | A1 | 7/2011 | Pervan |
| 2011/0225922 | A1 | 9/2011 | Pervan et al. |
| 2011/0252733 | A1 | 10/2011 | Pervan et al. |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0151865 | A1 | 6/2012 | Pervan et al. |
| 2012/0174515 | A1 | 7/2012 | Pervan et al. |
| 2013/0042562 | A1 | 2/2013 | Pervan et al. |
| 2013/0104487 | A1 | 5/2013 | Moriau et al. |
| 2014/0033635 | A1 | 2/2014 | Pervan et al. |
| 2014/0033636 | A1 | 2/2014 | Cappelle |
| 2014/0290174 | A1 | 10/2014 | Moriau et al. |
| 2015/0204080 | A1 | 7/2015 | Cappelle |
| 2015/0204081 | A1 | 7/2015 | Cappelle |
| 2015/0211238 | A1 | 7/2015 | Moriau et al. |
| 2016/0251861 | A1 | 9/2016 | Cappelle |
| 2017/0051514 | A1 | 2/2017 | Cappelle |
| 2017/0284106 | A1 | 10/2017 | Cappelle |
| 2024/0175271 | A1* | 5/2024 | Cappelle ..... E04F 15/045 |

FOREIGN PATENT DOCUMENTS

| | | | |
|---|---|---|---|
| CA | 2 359 419 | A1 | 5/2002 |
| CA | 2 456 513 | A1 | 2/2003 |
| CN | 1119152 | A | 3/1996 |
| CN | 1122623 | A | 5/1996 |
| CN | 1195386 | A | 10/1998 |
| CN | 2301491 | Y | 12/1998 |
| CN | 2364121 | Y | 2/2000 |
| CN | 1482166 | A | 3/2004 |
| CN | 2765969 | Y | 3/2006 |
| CN | 1911997 | A | 2/2007 |
| CN | 101023230 | A | 8/2007 |
| CN | 101072691 | A | 11/2007 |
| CN | 100354492 | C | 12/2007 |
| CN | 100523404 | C | 8/2009 |
| DE | 138385 | C | 4/1901 |
| DE | 1 534 802 | A1 | 4/1970 |
| DE | 2 159 042 | A1 | 6/1973 |
| DE | 27 21 292 | A1 | 11/1978 |
| DE | 28 56 391 | A1 | 7/1980 |
| DE | 2940945 | A1 | 4/1981 |
| DE | 33 43 601 | A1 | 6/1985 |
| DE | 254 920 | A1 | 3/1988 |
| DE | 39 32 980 | A1 | 11/1991 |
| DE | 42 15 273 | A1 | 11/1993 |
| DE | 42 42 530 | A1 | 6/1994 |
| DE | 195 32 819 | A1 | 3/1997 |
| DE | 196 01 322 | A1 | 5/1997 |
| DE | 197 25 829 | C1 | 8/1998 |
| DE | 200 08 708 | U1 | 9/2000 |
| DE | 199 40 837 | A1 | 11/2000 |
| DE | 19944399 | A1 | 4/2001 |
| DE | 199 58 225 | A1 | 6/2001 |
| DE | 200 20 505 | U1 | 4/2002 |
| DE | 202 05 774 | U1 | 8/2002 |
| DE | 101 38 285 | A1 | 3/2003 |
| DE | 203 00 306 | U1 | 4/2003 |
| DE | 202 03 782 | U1 | 7/2003 |
| DE | 203 10 959 | U1 | 9/2003 |
| DE | 203 00 291 | U1 | 11/2003 |
| DE | 103 05 695 | A1 | 9/2004 |
| DE | 103 16 695 | A1 | 10/2004 |
| DE | 20 2004 018 661 | U1 | 2/2005 |
| DE | 203 20 799 | U1 | 4/2005 |
| DE | 10 2004 055 951 | A1 | 7/2005 |
| DE | 10 2004 001 363 | A1 | 8/2005 |
| DE | 10 2005 002 297 | A1 | 8/2005 |
| DE | 10 2004 009 160 | A1 | 9/2005 |

(56) References Cited

FOREIGN PATENT DOCUMENTS

| | | | |
|---|---|---|---|
| DE | 10 2004 012 582 | A1 | 10/2005 |
| DE | 10 2004 023 157 | A1 | 11/2005 |
| DE | 20 2005 019 427 | U1 | 4/2006 |
| DE | 10 2006 054 023 | A1 | 12/2007 |
| EP | 0 007 230 | A2 | 1/1980 |
| EP | 0 013 852 | A1 | 8/1980 |
| EP | 0 130 559 | A2 | 1/1985 |
| EP | 0 562 402 | A1 | 9/1993 |
| EP | 0 864 712 | A2 | 9/1998 |
| EP | 0893473 | A1 | 1/1999 |
| EP | 0 974 713 | A1 | 1/2000 |
| EP | 1 026 341 | A2 | 8/2000 |
| EP | 1 120 515 | A1 | 8/2001 |
| EP | 1 138 467 | A1 | 10/2001 |
| EP | 1 146 182 | A2 | 10/2001 |
| EP | 1 154 090 | A1 | 11/2001 |
| EP | 1 247 641 | A1 | 10/2002 |
| EP | 1 262 607 | A1 | 12/2002 |
| EP | 1 262 609 | A1 | 12/2002 |
| EP | 1 279 778 | A2 | 1/2003 |
| EP | 1 290 290 | A1 | 3/2003 |
| EP | 1 308 577 | A2 | 5/2003 |
| EP | 1 033 201 | B1 | 7/2003 |
| EP | 1 350 904 | A2 | 10/2003 |
| EP | 1382774 | A1 | 1/2004 |
| EP | 1 420 125 | A2 | 5/2004 |
| EP | 1 441 086 | A1 | 7/2004 |
| EP | 1 454 763 | A2 | 9/2004 |
| EP | 1 469 140 | A1 | 10/2004 |
| EP | 1 493 879 | A1 | 1/2005 |
| EP | 1 593 795 | A1 | 11/2005 |
| EP | 1 593 796 | A1 | 11/2005 |
| EP | 1 650 375 | A1 | 4/2006 |
| EP | 1 705 309 | A2 | 9/2006 |
| EP | 1 872 959 | A1 | 1/2008 |
| EP | 1 892 352 | A2 | 2/2008 |
| EP | 1 938 963 | A1 | 7/2008 |
| EP | 2843155 | A1 | 3/2015 |
| EP | 2843155 | B1 | 4/2017 |
| FR | 1 138 595 | A | 6/1957 |
| FR | 2 149 112 | A5 | 3/1973 |
| FR | 2 256 807 | A1 | 8/1975 |
| FR | 2 271 365 | A1 | 12/1975 |
| FR | 2 609 664 | A1 | 7/1988 |
| FR | 2 810 060 | A1 | 12/2001 |
| FR | 2 827 529 | A1 | 1/2003 |
| GB | 240 629 | A | 10/1925 |
| GB | 518 239 | A | 2/1940 |
| GB | 900 958 | A | 7/1962 |
| GB | 1 015 701 | A | 1/1966 |
| GB | 1 171 337 | A | 11/1969 |
| GB | 1 467 899 | A | 3/1977 |
| GB | 1 520 964 | A | 8/1978 |
| GB | 2 020 998 | A | 11/1979 |
| GB | 2 051 916 | A | 1/1981 |
| GB | 2 145 371 | A | 3/1985 |
| GB | 2 376 916 | A | 12/2002 |
| JP | S60-255843 | A | 12/1985 |
| JP | S62-127225 | A | 6/1987 |
| JP | H03-110258 | A | 5/1991 |
| JP | H03-169967 | A1 | 7/1991 |
| JP | H05-18028 | A | 1/1993 |
| JP | H05-131594 | A | 5/1993 |
| JP | H05-214803 | A | 8/1993 |
| JP | H06-64108 | A | 3/1994 |
| JP | H06-146553 | A | 5/1994 |
| JP | H06-288017 | A | 10/1994 |
| JP | H06-306961 | A | 11/1994 |
| JP | H06-322848 | A | 11/1994 |
| JP | H07-180333 | A | 7/1995 |
| JP | 2000-170361 | A | 6/2000 |
| KR | 950019071 | U | 7/1995 |
| KR | 960005785 | A | 2/1996 |
| KR | 2001048980000 | Y1 | 4/1997 |
| KR | 20-0399316 | Y1 | 10/2005 |
| NL | 8000083 | A | 8/1981 |
| WO | 94/26999 | A1 | 11/1994 |
| WO | 95/11333 | A1 | 4/1995 |
| WO | 96/27721 | A1 | 9/1996 |
| WO | 97/18949 | A1 | 5/1997 |
| WO | 97/47834 | A1 | 12/1997 |
| WO | 99/17930 | A1 | 4/1999 |
| WO | 99/45060 | A1 | 9/1999 |
| WO | 99/66151 | A1 | 12/1999 |
| WO | 99/66152 | A1 | 12/1999 |
| WO | 00/20705 | A1 | 4/2000 |
| WO | 00/20706 | A1 | 4/2000 |
| WO | 00/47841 | A1 | 8/2000 |
| WO | 0063510 | A1 | 10/2000 |
| WO | 01/02669 | A1 | 1/2001 |
| WO | 01/02672 | A1 | 1/2001 |
| WO | 0102670 | A1 | 1/2001 |
| WO | 01/07729 | A1 | 2/2001 |
| WO | 01/09461 | A1 | 2/2001 |
| WO | 01/47724 | A1 | 7/2001 |
| WO | 01/47725 | A1 | 7/2001 |
| WO | 01/48333 | A1 | 7/2001 |
| WO | 01/51732 | A1 | 7/2001 |
| WO | 01/53628 | A1 | 7/2001 |
| WO | 01/66877 | A1 | 9/2001 |
| WO | 01/75247 | A1 | 10/2001 |
| WO | 01/83488 | A1 | 11/2001 |
| WO | 01/96688 | A1 | 12/2001 |
| WO | 01/96689 | A1 | 12/2001 |
| WO | 01/98604 | A1 | 12/2001 |
| WO | 0198603 | A2 | 12/2001 |
| WO | 02/00449 | A1 | 1/2002 |
| WO | 02/04206 | | 1/2002 |
| WO | 0208542 | A1 | 1/2002 |
| WO | 2002/055809 | A1 | 7/2002 |
| WO | 2002/055810 | A1 | 7/2002 |
| WO | 02/092342 | A1 | 11/2002 |
| WO | 03/012224 | A1 | 2/2003 |
| WO | 03/016654 | A1 | 2/2003 |
| WO | 03/016655 | A1 | 2/2003 |
| WO | 03/031750 | A1 | 4/2003 |
| WO | 03078761 | A1 | 9/2003 |
| WO | 03/083234 | A1 | 10/2003 |
| WO | 03/087497 | A1 | 10/2003 |
| WO | 03/089736 | A1 | 10/2003 |
| WO | 2004/015221 | A1 | 2/2004 |
| WO | 2004/020764 | A1 | 3/2004 |
| WO | 2004/037502 | A1 | 5/2004 |
| WO | 2004/042168 | A1 | 5/2004 |
| WO | 2004/063491 | A1 | 7/2004 |
| WO | 2004/079130 | A1 | 9/2004 |
| WO | 2004/083557 | A1 | 9/2004 |
| WO | 2004/085765 | A1 | 10/2004 |
| WO | 2005/002817 | A1 | 1/2005 |
| WO | 2005/018833 | A1 | 3/2005 |
| WO | 2005/033204 | A1 | 4/2005 |
| WO | 2005044536 | A2 | 5/2005 |
| WO | 2005/054597 | A2 | 6/2005 |
| WO | 2005/054599 | A1 | 6/2005 |
| WO | 2005054600 | A1 | 6/2005 |
| WO | 2005/068747 | A1 | 7/2005 |
| WO | 200588029 | A1 | 9/2005 |
| WO | 2005/098163 | A1 | 10/2005 |
| WO | 2006/033706 | A1 | 3/2006 |
| WO | 2006/042148 | A2 | 4/2006 |
| WO | 2006/043893 | A1 | 4/2006 |
| WO | 2006/056172 | A1 | 6/2006 |
| WO | 2006/066776 | A2 | 6/2006 |
| WO | 2006/090287 | A1 | 8/2006 |
| WO | 2006/103565 | A2 | 10/2006 |
| WO | 2006/104436 | A1 | 10/2006 |
| WO | 2006113690 | A2 | 10/2006 |
| WO | 2006125306 | A1 | 11/2006 |
| WO | 2006133690 | A1 | 12/2006 |
| WO | 2007008139 | A1 | 1/2007 |
| WO | 2007/059967 | A1 | 5/2007 |
| WO | 2007/081267 | A1 | 7/2007 |
| WO | 2007/113676 | A2 | 10/2007 |

(56) References Cited

FOREIGN PATENT DOCUMENTS

| | | | |
|---|---|---|---|
| WO | 2007/141605 | A2 | 12/2007 |
| WO | 2008/078181 | A1 | 7/2008 |
| WO | 2008/091045 | A1 | 7/2008 |

OTHER PUBLICATIONS

Notice of Opposition to EP14188952.7, Jan. 4, 2018, 32 pages.
Acknowledgment of Receipt of Notice of Opposition to EP14188952.7, Jan. 4, 2018, 563 pages.
Klage, Sep. 20, 2018, 19 pages.
Declaration of Ann-Christine Ayed, May 29, 2019, 108 pages.
Prosecution History for U.S. Pat. No. 9,200,460, 6683 pages.
IPR for U.S. Pat. No. 9,200,460, 1026 pages.
International Search Report from International PCT Application No. PCT/IB2007/000862, mailed Apr. 18, 2008.
Chang et al., "Advances in Polyurethane Coatings (1969 to Early 1972)", Product Review, Industrial & Engineering Chemistry Product Research and Development, vol. 12, No. 4, 1973.
Database WPI / Thomson Scientific, XP002621436, Feb. 16, 2011.
European Office Action from EP Application No. 14188952.7, Apr. 12, 2017.
Beitz et al., "Paperback for the Mechanical Engineering," Dubbel, 1990, pp. 58-59.
European Patent Opposition from EP Application No. 14188952.7, Jan. 4, 2018.
European Patent Opposition from EP Application No. 14188952.7, Dec. 19, 2018.
Petition for Inter Partes Review of U.S. Pat. No. 9,200,460, May 30, 2019.
Beitz et al., "Paperback for the Mechanical Engineering," Dubbel, as early as Jan. 1, 1990, 7 pages.
Curriculum Vitae of Ms. Ann-Christine Ayed in Support of Petition for Inter Partes Review of U.S. Pat. No. 9,200,460, May 29, 2019, 3 pages.
Decision from European Patent Office from Corresponding Patent Application No. EP17165499.9, Mar. 29, 2023.

* cited by examiner

FLOOR COVERING, FLOOR ELEMENT AND METHOD FOR MANUFACTURING FLOOR ELEMENTS

CROSS-REFERENCE TO RELATED APPLICATIONS

This application is a continuation of U.S. application Ser. No. 18/169,498, filed Feb. 15, 2023, now U.S. Pat. No. 11,933,055, which is a continuation of U.S. application Ser. No. 17/195,876, filed Mar. 9, 2021, now U.S. Pat. No. 11,680,414, which is a continuation of U.S. application Ser. No. 15/930,629, filed May 13, 2020, now U.S. Pat. No. 10,975,578, which is a continuation of U.S. application Ser. No. 16/670,722, filed Oct. 31, 2019, now U.S. Pat. No. 10,745,921, which is a continuation of U.S. application Ser. No. 16/510,433 filed Jul. 12, 2019, now U.S. Pat. No. 10,519,674 which is a continuation of U.S. application Ser. No. 16/160,120 filed Oct. 15, 2018, now U.S. Pat. No. 10,358,831, which is a continuation of U.S. application Ser. No. 15/866,932 filed Jan. 10, 2018, now U.S. Pat. No. 10,125,499, which is a continuation of U.S. application Ser. No. 15/623,484 filed Jun. 15, 2017, now U.S. Pat. No. 9,890,542, which is a continuation of U.S. application Ser. No. 15/342,490 filed Nov. 3, 2016, now U.S. Pat. No. 9,695,599, which is a continuation of U.S. application Ser. No. 15/151,106 filed May 10, 2016, now U.S. Pat. No. 9,487,957, which is a continuation of U.S. application Ser. No. 14/672,444 filed Mar. 30, 2015, now U.S. Pat. No. 9,366,037, which is a continuation of U.S. application Ser. No. 12/303,044 filed Dec. 1, 2008, now U.S. Pat. No. 8,991,055.

BACKGROUND OF THE INVENTION

1. Field of the Invention

This invention relates to a floor covering, to a floor element with which such floor covering can be composed, as well as to a method for manufacturing floor elements.

2. Related Art

Amongst others, the invention relates to floor elements comprising a substrate and a top layer, or to floor coverings composed of such floor elements. Herein, this may relate to the type of floor elements known from the DE 203 10 959 U1, the substrate of which is composed of laths, which substantially consist of softwood and wherein the top layer thereof consists of wood, such as floor elements with a top layer of veneer or with a wooden top layer with a thickness between 1 and 15 millimeters. However, the invention is not restricted to the above-mentioned type of floor elements, but on the contrary also may relate to laminate floor panels having a top layer based on synthetic material, or to still other types of floor elements, for example, floor elements comprising a decorative element of natural stone, baked stone or ceramics, such as, for example, those known from the EP 1 441 086.

It is known that such floor elements may be applied for forming a floating floor covering. Herein, these floor elements or floor panels, when being installed, are coupled at their edges, either by means of a conventional tongue and groove connection, wherein they possibly are glued into each other, or by means of mechanical coupling parts and locking parts providing, for example, in horizontal as well as in vertical directions for a locking of the floor elements, for example, such as described in the international patent application WO 97/47834.

SUMMARY OF THE DISCLOSURE

In general, the present invention, according to all of its aspects, aims at a floor covering or floor elements having, allowing, respectively, a better and/or sturdier and/or simpler to manufacture coupling among adjacent floor elements in a floor covering.

According to its first aspect, the invention relates to a floor covering of the kind consisting of floor elements, which, at least at a first pair of two opposite sides, comprise coupling parts, which substantially are performed as a male coupling part and a female coupling part, which are provided with vertically active locking portions, which, when the coupling parts of two of such floor elements cooperate with each other, effect a locking in vertical direction, perpendicular to the plane of the floor elements, and also are provided with horizontally active locking portions, which, when the coupling parts of two of such floor elements cooperate with each other, effect a locking in horizontal direction, perpendicular to the respective sides and in the plane of the floor covering, wherein said coupling parts are of the type allowing that two of such floor elements can be connected to each other at said sides by pushing one of these floor elements with the associated male coupling part, by means of a downward movement, home into the female coupling part of the other floor element. In English, a connection by means of such downward movement is better known by the denomination of "push-lock".

Coupling parts with associated locking portions allowing to mutually connect floor elements by bringing them towards each other by means of a downward movement are known, amongst others, from DE 10 2004 012 582 A1. A floor covering composed of floor elements with such coupling parts and locking portions, however, shows a limited strength of the locking, in particular of the locking in vertical direction, and has a relatively high risk of the coupling coming loose, even with a normal use of the floor covering.

From WO 01/98604 and DE 101 38 285, it is known to implement the male coupling part of such floor elements with a vertical active locking portion in the form of a bendable lip-shaped portion, which elastically bends during the downward coupling movement and thereby performs a turning movement in order to spring back at the end of the coupling action and to get seated in an undercut of the female coupling part. However, the embodiments known from these documents still show a number of disadvantages. The embodiment of WO 01/98604, for example, shows the disadvantage that the male coupling part is made in a V-shape, such that the bendable lip-shaped portion is supported in a relatively weak manner and the locking shows a limited strength. Under the influence of a vertical pressure load onto the connection, for example, when walking thereon, a V-shaped coupling part may deform and a height difference may develop between two adjacent floor panels; under the influence of a horizontal tension load, for example, when the floor elements crimp in dry periods, a V-shaped male coupling part also may deform and there is an increased risk that a gap forms between two adjacent floor panels. In both patent documents, WO 01/98604 and DE 101 38 285, the bendable lip-shaped portion moreover is implemented on a separate edge portion, which is integrated into the substrate of the floor panels in a relatively weak manner.

Other examples of such coupling parts and locking portions are known from WO 2005/054599 and EP 1 650 375. Here, too, use is made of a deformable portion, however, not of a bendable lip-shaped portion, for the vertically active locking portion. The deformable portion known from this document is made, as a whole, as a movable insert, which, during the downward coupling movement, is intended to perform a translation movement in its seat. This requirement concurrently effects that this deformable portion or this insert is integrated in the substrate of the respective floor elements in a weak manner. Moreover, due to the translation movement forces may occur having a splitting effect onto the substrate of the floor element, whereby in such floor clement, in particular when coupling it repeatedly, the strength of the coupling may be lost.

With the intention of restricting, amongst others, the risk of said coming loose or providing, in general, a better coupling among floor elements in a floor covering, wherein preferably at least one of the above-mentioned prior art problems is solved, the present invention relates to a floor covering of the above-mentioned kind, with as a characteristic that the male coupling part has a downwardly directed recess dividing this coupling part into, on the one hand, an upwardly directed bendable lip-shaped first portion functioning as one of said vertically active locking portions, and, on the other hand, a more massive second portion, wherein these portions are made in one piece of one and the same material.

Preferably, the more massive second portion shows a full structure over the majority of its height, and preferably over its entire height, however, it is not excluded that this more massive second portion comprises a hollow structure, wherein this hollow structure then preferably is constructed such that the second portion is acting more massive, in other words, sturdier, than the first portion, such that the second portion, when being coupled by means of the above-mentioned downward movement, preferably is deformed hardly or not at all.

Preferably, the more massive portion, over the majority of its height, viewed in a horizontal cross-section, has a thickness that is larger than the thickness of the first portion, both thicknesses being measured in the same horizontal cross-section. Even better, the second portion, over the majority of its height, is at least two times thicker than the first portion. It is noted that in order to determine the respective thicknesses, internal cavities as a result of a possible hollow structure in the respective portions must be regarded as massive and thus must be factored in entirely in order to determine the thickness, as long as the second portion, as aforementioned, is acting more massive than the first lip-shaped portion.

By embodiments according to the first aspect, it is obtained, on the one hand, that the first portion is sufficiently flexible in order to perform the coupling action by means of the downward movement, whereas, on the other hand, it is obtained that this first portion is suspended on a sufficiently sturdy base, such that it will be substantially only the first portion, which, during and/or after coupling, is exposed to a bending or turning movement. According to the characteristics of the first aspect, the male coupling part clearly is not V-shaped and the above-mentioned risks and disadvantages brought about by a V-shaped coupling part are limited.

Preferably, the bendable lip-shaped first portion is designed such that it can be bent or turned at least towards the second, more massive portion. With such embodiment, a coupling by means of a downward or substantially vertical movement is easier to obtain.

The aforementioned horizontally active locking portions preferably are formed by, on the one hand, an upright locking portion at the female coupling part, and, on the other hand, a locking portion on the male coupling part cooperating therewith. Preferably, the horizontally active locking portion of the male coupling part forms part of the aforementioned, more massive second portion and is this horizontally active locking portion made in one piece in the same material with the second, more massive portion. In such case, a particularly accurate locking with a good strength of the connection may be obtained.

The cooperation among two floor panels of the invention preferably shows at least one or a combination of two or more of the following three features:

- the feature that the cooperation of the vertically active locking portions consists at least in that, in the coupled condition of two of such floor elements, the bendable lip-shaped first portion, at its distal extremity, contacts a wall of the female coupling part;
- the feature that, in the coupled condition of two of such floor elements, the underside of the second more massive portion contacts a wall of the female coupling part;
- the feature that the cooperation of the horizontally active locking portions consists at least in that, in the coupled condition of two of such floor elements, the upright locking portion of the female coupling part contacts the horizontally active locking portion of the male coupling part.

In the most preferred form of embodiment, the cooperation among two floor elements shows all features mentioned herein above. This most preferred form of embodiment allows forming a floor covering according to the first aspect, with a high quality of the coupling of such floor elements that has been obtained in this manner.

It is clear that in the cooperation among two floor elements preferably also at least one contact is formed at the height of the upper edges of the respective floor elements. It is noted that the coupling parts preferably allow that after coupling, a play-free, or anyhow at least almost play-free, connection among two of such floor elements is obtained.

According to an important form of embodiment, the floor elements, at the side comprising the aforementioned male coupling part, are provided with a separate edge portion, in which the aforementioned first portion and the aforementioned second portion are made in one piece.

According to said first aspect of the invention, as well as according to all the following aspects of the invention, in which a separate edge portion is mentioned, by such "separate edge portion" is meant that the edge portion is provided separately, with the intention of performing at least the coupling function, and that the floor element, globally seen, substantially is constructed of other portions or other material than the aforementioned separate edge portion. It is noted that such separate edge portion may be designed as a separate portion, which, for example, is or can be mechanically connected to the actual floor panel, as well as can be designed as a portion, which industrially is fixedly connected to the actual floor panel at least by means of another connection technique, such as by means of adhering or by integration into a possible substrate of the floor element.

By providing such edge portion, the material of this edge portion can be entirely adapted to its desired function, for example, amongst others, that of coupling, whereas the remaining portions of the floor element can be made of the materials being usual for the respective type of floor panel. The fact that the second portion is more massive in this case allows obtaining a better integration of the separate edge portion with the floor element.

According to an example of this important form of embodiment, the aforementioned separate edge portion may be realized as an insert, meaning that it has been provided in or at the floor panel as one fixed whole. Herein, it is possible that the aforementioned edge portion, insert, respectively, forms the entire respective side of the floor element, preferably with the exception of a possible top layer and/or backing layer and/or other globally horizontal-extending layers, such as sound-damping layers being, for example, of the type as known from WO 03/016655. It is also possible that such separate edge portion is provided at both of said first pair of opposite sides, wherein then preferably also the female coupling part is realized at least partially, and still better including the aforementioned vertically and horizontally active locking portions, in the respective separate edge portion.

In general, it is noted that synthetic material is particularly suited for forming the aforementioned material of which the first and second portions are made in one piece. Synthetic material allows realizing the first lip-shaped first portion with small dimensions, while still retaining a sufficient elastic bending ability thereof for the coupling action. Preferably, this relates to a synthetic material on the basis of polyurethane and/or on the basis of a fully reacted polyurethane/isocyanate composition. The application of such materials is particularly useful when the aforementioned material relates to the material of a separate edge portion, such as that of an insert or of a separate edge portion provided on the floor clement in any manner. Synthetic material, such as material on the basis of polyurethane and/or on the basis of a fully reacted polyurethane/isocyanate composition, is also extremely suitable for providing said separate edge portion by means of casting or injection molding at the floor element, wherein it is not excluded that, by the same casting process, also other portions are provided on and/or in the floor element.

Said coupling parts and/or locking portions may be formed in any manner. So, for example, they may be formed as milled profiles, as extruded profiles, or by a combination of extrusion and a machining treatment, such as milling or the like. When said coupling parts and locking portions are formed as milled profiles, it is preferred that the milling treatment takes place while the aforementioned material, in which the bendable lip-shaped first portion and the second portion are made in one piece, already is provided in or on the floor element, and even better, in order to obtain a high accuracy, in the same milling treatment at least also the upper edge of the respective side of the floor element is formed. By such technique, higher precisions are obtained than by a technique, wherein an already formed profile is provided as an insert in the substrate of the floor elements. By "the same milling treatment", it is not necessarily intended that the upper edge is formed with the same milling tools, however, that the reference frame in which this milling treatment takes place is the same reference frame as the one in which the profiles are formed.

When the aforementioned coupling parts and locking portions are formed as extruded profiles, use can also be made of the technique of co-extruding, wherein several synthetic materials together are extruded to one massive whole.

According to the first aspect and the other aspects described hereafter, the floor elements of the present invention can be formed according to a plurality of possibilities.

According to a first possibility, the aforementioned floor panels may be formed as floor panels with a substrate substantially consisting of wood or wood-based materials, wherein then preferably a separate edge portion is provided at least at one side of the substrate, wherein said bendable first portion and the second, more massive portion are made in one piece.

Examples of wood or wood based materials are spruce wood or other types of softwood, chipboard, fiberboard, MDF or HDF (Medium Density Fiberboard or High Density Fiberboard). In the case of materials such as spruce wood or other softwood, these materials preferably are present in the substrate in the form of adjacent-situated laths.

According to said first possibility, the floor elements may relate to floor panels with a wooden top layer, such as a top layer of veneer or of a layer of wood from 1 to 15 millimeters, such as, for example, prefabricated parquet, wherein then preferably also a wooden backing layer is present at the bottom side of the floor panels. So, for example, may the respective floor panels be of the type that comprises a substrate composed of adjacent-situated laths, wherein on this substrate a wooden top layer, whether or not composed of several parts, is provided, whereas a backing layer is provided against the bottom side of this substrate, said separate edge portion being formed by means of one of the aforementioned laths, to which aim this lath consists of a material, preferably a material containing synthetic material, wherein this material differs from the material of which the majority of the other laths is made, wherein it is not excluded that the material of the majority of the other laths also may comprise synthetic material. Floor panels with a wooden top layer, the substrate of which comprises wooden or wood-based portions, such as laths, are better known in English under the generic denomination "engineered wood". When in such floor element, said backing layer is omitted and the floor element thus substantially consists of the substrate, possibly constructed of said laths, and the wooden top layer, this relates to dual layer parquet, which is known better under the German denomination of "Zweischichtparkett".

According to the same first possibility, the respective floor panels may be of the type that comprises a substrate and wherein the separate edge portion forms part of a material part situated in a groove-shaped recess in the edge of the substrate. Herein, this may relate, for example, to floor elements with a top layer on the basis of synthetic material, as it is the case, for example, with laminate flooring. In such laminate flooring, the top layer of the floor panels may comprise carrier sheets immersed in resin or in synthetic material, said sheets consisting, for example, of paper, wherein at least one of these carrier sheets shows a printed décor that is visible at the upper side of the floor panels and forms a so-called decorative layer. Preferably, with such floor panels also a backing layer on the basis of such resin-impregnated carrier sheet is provided at the bottom side thereof. In laminate flooring, for the actual substrate preferably use is made of MDF or HDF.

Of course, the floor element, according to this first possibility, also may relate to a floor element substantially consisting of a massive wooden floor panel, wherein then preferably a separate edge portion is provided at least at one side of this floor panel.

As aforementioned, in the first possibility preferably use is made of a separate edge portion. With such configuration, during the aforementioned bending or turning movement of the bendable lip-shaped first portion, a reduced or almost no splitting effect is exerted on the actual substrate of the floor element, which is particularly important for wood-based substrates, such as substrates of MDF or HDF.

According to a second possibility, the aforementioned floor elements may be formed as tiles showing at least a decorative element of real ceramics, baked stone or natural stone. Herein, this may relate to floor elements of the type known from EP 1 441 086 or to any other floor element comprising a decorative element of real ceramics, baked stone or natural stone.

According to a second independent aspect, the invention also relates to a floor covering of the kind mentioned in relation to the first aspect, with the characteristic that the floor elements comprise a substrate and a top layer, wherein the male coupling part is at least partially formed on a separate edge portion, preferably an insertion part, which is present in the substrate at the respective side, and the male coupling part has a downwardly directed recess, said recess, dividing this coupling part into, on the one hand, bordering an upwardly directed bendable lip-shaped first portion at the male coupling part; that the separate edge portion comprises a basic portion with which this edge portion is seated at least partially in the actual floor panel, such that this basic portion, at the upper side as well as at the lower side, is bordered by the remaining material of the floor element; and that, seen in vertical section through the basic portion and the surrounding material, the basic portion extends over a distance being at least half of the thickness of the substrate.

According to this second independent aspect, an improved integration of the separate edge portion, the insert, respectively, in the floor element is obtained. This may be of importance, for example, in the case that the respective coupling parts and/or locking portions in the separate edge portion or insert are realized as milled profiles, whereas the separate edge portion is already provided in or at the substrate, as with such treatment, forces are exerted onto the separate edge portion or insert, which forces might pull it out of its desired position in the substrate. Therefore, a good integration of the separate edge portion or the insert is important for achieving a good precision when forming the coupling parts and/or locking portions.

Such good integration is also of importance in the case of the occurrence of a horizontal tension load on the connection. As aforementioned, such tension load may occur when the floor elements are subjected to crimping, for example, in dry periods.

It is preferred that, viewed in said vertical cross-section, said distance is at least 60 percent, and still better at least 70 percent, of the thickness of the substrate. Optimally, said distance, viewed in said vertical cross-section, is between 80 and 100 percent of the thickness of the substrate.

According to the second aspect, it is not necessary to make the separate edge portion of only one material. An important example of the second aspect relates to a floor element, the separate edge portion of which in fact is made in one piece, however, comprises various materials, such as this is the case, for example, with a separate edge portion made by co-extrusion. Such separate edge portion, for example, enables making said second portion substantially of a less clastic material than the first portion, whereas they both are situated on the same separate edge portion.

According to an important form of embodiment, a horizontally active coupling portion is situated at the male coupling part, said coupling portion also being situated in the separate edge portion, wherein said basic portion, in respect to the floor element, is situated more proximally than said horizontally active locking portion. Preferably, this relates to a horizontally active locking portion of the type that can cooperate with an upright horizontally active locking portion of the female coupling part.

It is clear that this second aspect can be performed in a beneficial manner in combination with the characteristics of said first aspect and its preferred forms of embodiment.

According to a third independent aspect, the present invention also relates to a floor covering of the kind discussed in the first aspect, with as a characteristic that at least one of both coupling parts, either the male coupling part or the female coupling part, has a recess that divides this coupling part into, on the one hand, an inwardly bendable lip-shaped first portion functioning as one of the aforementioned vertically active locking portions, and, on the other hand, a second portion, wherein the, in respect to the respective floor panel, proximal flank of the recess extends from the base of the recess towards the opening of the recess inclined towards the outer edge of the floor element. Preferably, the in respect to the floor element distally-situated flank of the recess herein forms a flank of said first portion.

According to the third aspect, the recess is made such that, for bending or turning said first portion, a free space is obtained consisting at least partially of an undercut, whereby said first portion can bend or turn at least with its distal end, if this should be necessary, during coupling by means of a downward movement as far as underneath the top surface of the respective floor clement.

Said proximal flank may serve as a stop surface for the first portion, such that this latter does not lose its resiliency by bending or turning too far in the coupling process, or when performing the coupling process repeatedly, which is beneficial to the strength of the coupling.

In a preferred form of embodiment, the turning point of the lip-shaped first portion, anyhow, at least in the not coupled condition, is situated vertically underneath the top surface of the respective floor panel, which exerts a beneficial influence onto the coupling by means of a downward movement.

In the most important forms of embodiment of the third aspect, the coupling part forming said recess is the male coupling part. Herein, most beneficially said recess is directed downward, whereas the bendable lip-shaped first portion is directed upward. In such case, it is desirable to provide for that the extension of said proximal flank of the recess extends farther than the upper edge of the respective floor element or just touches this upper edge. In this manner, it is obtained that the recess is simple to realize as a milled profile, as a recess with these features to be realized is better accessible to a milling tool. Moreover, that part of the lip-shaped first portion that, in not coupled condition, extends farther than the upper edge of the respective floor element can be kept limited, whereas still a sufficient bending or turning ability of the lip-shaped portion can be obtained.

When, in other forms of embodiments, the coupling part having the recess is the female coupling part, said recess preferably is directed upward, whereas the bendable lip-shaped first portion is directed downward.

In respect to the degree of inclination of said proximal flank of the recess, an inclination forming an acute angle of 10° with the vertical may suffice. However, preferably this relates to a larger angle, such as an angle of 30° or more, even if it is preferable to provide for this angle being smaller than 70°.

Of course, the characteristics of the third aspect may also be of importance with a floor covering with the characteristics of said first and/or second aspects.

According to a fourth independent aspect, the present invention also relates to a floor covering of the kind mentioned in the first aspect, with as a characteristic that the floor elements comprise a wooden or wood-based actual substrate and a top layer, wherein at least one of both coupling parts, either the male coupling part with its associated locking portions, or the female coupling part with its associated locking portions, are formed entirely on a separate edge portion of synthetic material, preferably an insert of synthetic material, which is present in the substrate at the respective side, whereas the coupling part at the opposite side is formed at least partially, and preferably entirely, in the wooden or wood-based actual substrate.

In a preferred form of embodiment of this fourth independent aspect, it is the side having the male coupling part at which the coupling parts and locking portions are formed entirely on a separate edge portion or insert of synthetic material.

The inventive idea of applying synthetic material at a side of a floor element offers improved possibilities for realizing coupling parts and locking portions allowing that two of such floor elements can be connected to each other by moving them towards each other by a downward movement. So, for example, may the bendable lip-shaped first portion mentioned in the first, second and third aspects be performed with improved features such, that an improved coupling is obtained. Also, applying a separate edge portion of synthetic material, such as a plastic insert, at the opposite sides as well may be redundant and may involve unnecessary costs and operations. Therefore, according to the fourth aspect, the coupling parts and locking portions at the opposite side are made at least partially, and preferably entirely, of an inexpensive and/or easy to process material, such as wood or wood-based material.

The use of synthetic material also allows applying coupling parts and locking portions that are realized in another manner than milled profiles. Thus, for example, they may be realized as extruded profiles. This technique allows a very large constructional freedom.

This fourth aspect is very useful when realized in combination with the first, second and/or third aspects. Herein, it is clear that then preferably the side carrying the coupling part with the bendable lip-shaped first portion is entirely made of synthetic material, possibly with the exception of a top layer and/or backing layer present at the floor element.

It is noted that the inventive idea of the invention disclosed by means of the fourth aspect, namely the application of a separate edge portion of synthetic material for realizing coupling parts and locking portions, may also find a broader application. The additional constructional freedom that can be obtained with such a material also is advantageous with other kinds of floor coverings than those disclosed by means of the first to the fourth aspects. So, for example, may this idea also be of importance for floor coverings of which the floor elements are composed to a more complex laying pattern, such as a herringbone pattern.

From WO 2004/063491 is known how more complex laying patterns, such as a herringbone pattern, can be realized by means of two kinds of floor elements, which differ from each other in that they are made in a mirrored manner, anyhow, at least in respect to the coupling parts and locking portions thereof.

From WO 2005/098163 moreover in the meantime is known how such more complex laying pattern may also be realized with only one kind of floor elements. A precondition for being able to form more complex laying patterns, such as a herringbone pattern with only one kind of floor elements, is that both sides of a first pair of opposite sides of a first floor element can cooperate with both sides of a second pair of opposite sides of a second floor element. As is evident from the forms of embodiment in WO 2005/098163, this precondition rapidly leads to complex coupling profiles which are difficult to provide directly in the substrate, in particular when this substrate is made of wood or wood-based material, such as MDF or HDF.

According to its fifth independent aspect, the present invention relates to floor coverings that are composed of floor elements allowing the realization of more complex laying patterns, however, the coupling profiles of which are simpler to realize. To this aim, the present invention relates to a floor covering composed of floor elements with a first pair of opposite sides and a second pair of opposite long sides, wherein the floor elements, at the first pair of opposite sides as well as at the second pair of opposite sides, comprise coupling parts, wherein the coupling parts situated at the second pair of opposite sides substantially are made as a male coupling part and a female coupling part and respectively can cooperate with the female coupling part and the male coupling part of the second pair of opposite sides of an identical floor element, and wherein the coupling parts of both opposite sides of the first pair of sides are designed such that each of these coupling parts can cooperate with the male coupling part as well as with the female coupling part of the second pair of opposite sides of an identical second floor element, with as a characteristic that the coupling parts situated at the first pair of opposite sides of the floor elements are made at least partially, and preferably entirely, of a synthetic material. It is clear that the floor covering of the fifth aspect preferably is composed in a herringbone pattern.

Preferably, the floor covering of the fifth aspect is composed of rectangular oblong floor elements, wherein the short sides of these floor elements determine the aforementioned first pair of opposite sides and wherein the long sides of these floor elements determine the aforementioned second pair of opposite sides.

According to an important form of embodiment of the fifth aspect, the floor elements comprise at least a substrate, whether or not consisting of several parts, and a top layer, wherein the substrate substantially consists of wood or wood-based materials, and the coupling parts situated at the aforementioned second pair of opposite sides of the floor elements are integrally formed in this wood or wood-based material, whereas the coupling parts situated at both sides of the aforementioned first pair of opposite sides of the floor elements are formed in separate plastic edge parts, which latter are provided at the respective sides of the floor elements.

Said male coupling part and female coupling part can be provided with vertically active and horizontally active locking portions, such that, in the aforementioned cooperation of the second pair of sides of two identical floor elements, a mutual locking is present in vertical direction, by means of the vertically active locking portions, as well as in horizontal direction, by means of the horizontally active locking portions. The coupling parts situated at both sides of the first pair of opposite sides of a floor element can also be provided with vertically active and horizontally active locking portions, such that in the aforementioned cooperation with the male coupling part, as well as in the aforementioned cooperation with the female coupling part of the second pair of sides of an identical floor element, there is a mutual locking in a vertical direction, by means of the vertically active locking portions, as well as in horizontal direction, by means of the horizontally active locking portions.

According to a sixth independent aspect, the invention also relates to a method for manufacturing floor elements, which comprise at least a decorative element defining at least partially the upper side of the respective floor element, and which have coupling parts at least at two opposite sides, wherein the floor elements, at least at one of these sides, are provided with a separate edge portion of synthetic material, whereas the floor elements, globally seen, are constructed of another material than the material of the edge portion, with as a characteristic that the method comprises at least the following two successive steps:

the step of producing a semi-finished product comprising at least said edge portion and said decorative element, wherein the edge portion, when producing the semi-finished product, already is provided or is being provided with a portion of the coupling part to be formed therein; the step of performing a machining treatment on the separate edge portion of an already formed semi-finished product in order to fabricate at least a portion of the coupling part to be formed therein.

It is noted that by "successive steps" is meant that the machining treatment takes place after the semi-finished product has been produced and it is, thus, not excluded that in between these successive steps, one or more other manufacturing steps take place.

The machining treatment preferably consists at least of a milling process, for example, with rotating milling tools. A very suitable synthetic material for this application is a synthetic material comprising polyurethane and/or produced on the basis of a mixture of polyurethane and isocyanate. Further, use can also be made of filled synthetic material composites, such as extruded wood, which comprises wood fibers and/or wood chips as a filling material. The composition of such material may be optimally adapted to the milling process and the profile to be realized. Moreover, when treating extruded wood, the same milling tools may be used as when processing a wood-based material, such as MDF or HDF. In that the milling technology is the same as or similar to the usual technology for fabricating wooden or wood-based floor elements, switching to extruded wood is possible for flooring manufacturers without many difficulties or high costs.

According to a first possibility, when producing the semi-finished product, said edge portion is provided in the semi-finished product as an insert. In an important application of this first possibility, the semi-finished product is produced by bringing together wooden or wood-based laths with the aforementioned separate edge portion of synthetic material and providing the decorative element as a top layer on these laths and edge portion, wherein preferably also a backing layer is provided underneath these laths and edge portion. Preferably, said separate edge portion also is performed as a lath.

According to a second possibility, when producing said semi-finished product, said edge portion is realized at least partially by providing a solidifying substance at the respective side; for example, this substance may be provided by spraying. This solidifying substance preferably comprises at least an elastomer on the basis of polyurethane, such as, for example, a synthetic material provided on the basis of a mixture of polyurethane and isocyanate. It is also possible that, for example, extruded wood is directly formed on or extruded onto the semi-finished product.

According to this second possibility, for example, said edge portion may be realized by casting or at least partially encapsulating the decorative element into synthetic material, such as polyurethane, or filled synthetic material. In this manner, for example, such decorative element, for example, a tile, may provided at its edges and possibly also at its bottom with synthetic material by such casting process. Possibly, said bottom may form a carrier structure for the decorative element. It is noted that the encapsulated decorative elements as such are known, for example, from WO 2006/042148.

The first as well as the second of the hereinabove mentioned possibilities may be applied when, for producing the semi-finished product, one starts from a board-shaped material, upon which the decorative element is provided as a top layer, and wherein said edge portion in which the machining treatment is performed, is provided at this board-shaped material, thus, when this board-shaped material already is provided with a top layer. This board-shaped material may have been formed in a preceding step as a board of laminate material with a top layer on the basis of synthetic material, such as a top layer on the basis resin-immersed carrier sheets of paper. For forming the board of laminate material, for example, use may be made of a DPL (Direct Pressure Laminate) process, wherein the top layer is provided by pressing the respective resin-immersed carrier sheets together with the basic board at an increased temperature.

The aforementioned first possibility may, for example, also be applied when the semi-finished product is composed by bringing together wooden and/or wood-based laths with the separate edge portion, which then preferably is also present as a lath, in order to form a substrate, or anyhow at least a portion of a substrate, and providing a decorative layer, for example, in the form of a wooden top layer, as a top layer on this substrate, wherein it is desirable that also a backing layer is provided below these laths and edge portion. By such method, for example, "engineered wood" floor panels can be manufactured with a separated edge portion or insert, in which the coupling parts are provided, said portion or insert being integrated at least at one side thereof, preferably at least at one of the short sides of an oblong floor panel.

According to still another form of embodiment of this sixth aspect, it is possible that the method is applied for manufacturing a floor element, wherein said semi-finished product substantially is formed of a tile or the like of a stone-like material, at which then, directly or indirectly, said separate edge portion of synthetic material is provided. Herein, the stone-like material may relate, for example, to natural stone, artificial stone, baked stone, ceramics or the like.

Preferably, the method is used for manufacturing floor panels of the type of which said coupling parts formed by means of the machining treatment allow that two of such floor elements can be interconnected at the respective sides by pushing one of these floor elements, by means of a downward movement, home into the other floor element. It is in particular with floor elements of this type that the application of a separate edge portion of synthetic material or filled synthetic material composite offers advantages. The coupling of two floor elements by means of a downward movement takes place most beneficially when the coupling parts have relatively thin bendable portions. Thus, these portions preferably are made in said synthetic material of the separate edge portion, as synthetic material or filled synthetic material composite allows for a larger constructional freedom than the usual wood-based materials, such as MDF or HDF.

Of course, the method of the sixth aspect is very suitable for realizing the floor elements of which the floor coverings of the first through the fifth aspect are composed. In the case that the method is applied for realizing floor elements that can be composed to floor coverings with the characteristics of the first through the third aspect, preferably at least said bendable lip-shaped first portion intended to function as a locking portion and/or said recess are formed by means of the machining treatment, more particularly at least by means of a milling process by means of rotating milling tools.

According to a seventh independent aspect, the invention also aims at a floor covering of the type mentioned in the first aspect, which is easy to manufacture and/or induces a series of new possibilities for such floor coverings and/or the floor elements of which they are composed. More particularly, it is possible to obtain, by means of such floor elements, connections by means of a so-called "push-lock", which are stronger and/or can be applied more broadly. To this aim, the invention relates to a floor covering of the above-mentioned type, with as a characteristic that at least one of the coupling parts, either the male coupling part or the female coupling part, is at least partially made of a filled synthetic material composite, preferably a fiber-filled synthetic material composite.

The composition of such synthetic material composites may be adapted to the design, the appearance and/or the required functionality of the final respective coupling part. So, for example, may the synthetic material contents or the type of synthetic material be adapted according to the required flexibility, or the filling material or the form thereof may be chosen according to the desired strength or rigidity, namely, Young's modulus, of the composite. Possibly, such synthetic material composite may also comprise at least two zones of different composition. Such zones may be obtained, for example, by means of co-extrusion. Further, also the color of such synthetic material easily can be adapted. A highly suitable filled synthetic material composite for application in a floor covering according to this seventh aspect is a composite, the filling material of which contains wood fibers and/or wood chips, such as this is the case with extruded wood. However, other filling materials may be applied, too. In the case of a fiber-filled synthetic material, the fibers also may be substantially formed by hemp fibers. Others than the aforementioned organic filling materials are possible, too, such as glass fibers, as well as inorganic filling materials are possible, such as glass fiber, carbon fibers and the like.

As a synthetic material, for example, a thermoplastic material may be applied in said composite, preferably a polyester, such as polyethylene terephthalate (PET), which, for example, may be recycled from waste material. Also, a synthetic material, such as polyethylene, polypropylene, polystyrene, polycarbonate or polyvinylchloride may be chosen. All of these synthetic materials allow keeping the temperature during extruding relatively low, such that the applied filling material is not affected. It is evident that this temperature depends on the type of filling material. For wood chips or wood fibers, one may work, for example, with an extrusion temperature between 100 and 200° C., and still better between 120 and 150° C. The mixing ratios between the applied synthetic material and the applied filling material preferably are between 70/30 and 20/80. Further examples of such materials are described, for example, in WO 2005/033204 or WO 2005/002817.

It is noted that synthetic material composites filled with wood chips and/or wood fibers may show an appearance or a touch that approaches real wood or other wood-based materials, such as MDF. The presence of such material thus may render the product more trustworthy to the users than the presence of a material with the appearance of synthetic material.

The floor elements of such floor covering may be implemented in various manners.

According to a first possibility, said floor elements comprise at least a substrate and a separate edge portion, preferably an insert. Herein, said filled synthetic material composite may be present at least in said separate edge portion and/or this separate edge portion or insert consists of filled synthetic material composite. Further, said separate edge portion or insert may form the entire respective side of the floor element, with the exception of a possible top layer and/or a backing layer that may be present at the substrate.

Still according to this first possibility, the actual substrate of the floor element may substantially consist of one or more other materials than said filled synthetic material or may not at all consist of filled synthetic material. So, for example, for the actual substrate use may be made of softwood, such as spruce wood, chipboard, fiberboard, MDF or HDF.

According to a particular preferred form of embodiment of this first possibility, said floor elements are formed as floor panels with a substrate that substantially consists of wood or wood-based materials, wherein then preferably at least at one side of the substrate a separate edge portion of filled synthetic material is provided, in which the respective coupling part is made in one piece. The respective floor elements may be, for example, of the type of "engineered wood" or, more particularly, of the type which comprises a substrate that is composed of adjacent-situated laths, wherein on this substrate a wooden top layer, whether or not composed of several parts, is provided, wherein the separate edge portion is formed by means of one of said laths, wherein the respective lath is constructed of filled synthetic material. Possibly, also a backing layer may be provided against the underside of this substrate. If this backing layer is absent, then in the technical jargon one is speaking of "tweelaagsparket" (in English: dual layer parquet; in German: Zweischichtparkett). It is clear that in such floor covering, too, the application of a separate edge portion of filled synthetic composite can be desirable.

According to a second possibility, said floor elements comprise at least a substrate, wherein this substrate substantially consists of said fiber-filled synthetic material composite. Of course, such substrate can be provided with a top layer and/or a backing layer. Examples of top layers are wooden top layers, such as veneer, or decorative films and other layers comprising a printed décor, such as laminate layers of the DPL (Direct Pressure Laminate) or HPL (High Pressure Laminate) type. Preferably, said substrate forms at least one side and preferably both sides of said first and/or second pair of opposite sides.

In the floor elements of the seventh aspect, the respective coupling part may entirely or partially be made of said filled synthetic material composite. Also, both coupling parts, the male coupling part as well as the female coupling part, may have at least a portion that is made of said filled synthetic material composite. Also, they may both be made entirely of this synthetic material composite.

The floor elements of the seventh aspect may be rectangular, wherein then preferably the first pair of opposite sides forms the short sides of the floor elements and thus such filled synthetic material composite is applied at least at one of these short sides. It is clear that the floor elements also may have a second pair of opposite sides, which also are provided with mutually cooperating coupling parts, which substantially are made as a male and a female coupling part, which are provided with vertically active locking portions and horizontally active locking portions. Two of such floor elements may be connected to each other at said second pair of opposite sides by pushing one of these floor elements with the associated male coupling part, by means of a downward movement, home into the female coupling part of the other floor element. It is possible that the coupling parts of the second pair of opposite sides have characteristics identical to those of the coupling parts and locking portions of the first pair of opposite sides. However, other connection methods or characteristics are not excluded for this second pair. For example, it is possible that the coupling parts of the second pair of opposite sides, additionally or solely allow interconnecting two of such floor elements at this pair of sides by providing one of these floor elements with the associated male coupling part, by means of a turning movement and/or by means of a horizontal shifting movement, in the female coupling part of the other floor element.

Said coupling parts of the seventh aspect may be formed, for example, as milled and/or extruded profiles. In the case of said first possibility and in the case that a milling treatment is applied, it is preferred that the final shape of the respective coupling part, which at least partially is made in filled synthetic material composite, is obtained by this milling treatment, while the separate edge portion or insert is already situated at the floor element or a semi-finished product thereof. Possibly, this edge portion already may show the global shape of the respective coupling part prior to its connection with the floor element, for example, in that the filled synthetic material has been extruded and/or pre-milled as such. However, according to the invention it is not excluded that the coupling parts are formed entirely in the insert or separate edge portion prior to connecting this edge portion with the floor element. This may take place by any technique, for example, by milling and/or extruding.

It is noted that the present invention also relates to floor panels that are obtained by applying the method of the sixth aspect. Also, the present invention relates to floor panels that can be applied for composing a floor covering with the characteristics of the first, the second, the third, the fourth, the fifth and/or the seventh aspects.

Further, it is noted that, according to the invention, pushing the male coupling part, by means of a downward movement, home into the female coupling part, anyhow, at least in respect to the embodiments according to the first through the third aspects, implies that said bendable lip-shaped first portion always is a bendable portion providing for a snap-on and/or engaging action. Also with other "push-locks", preferably a snap-on and/or engaging action takes place. However, this snap-on and/or engaging action does not necessarily have to be realized by means of a lip-shaped portion, but may also be realized by means of any bendable and/or deformable portion, which is present at least at one of the respective sides to be coupled. Such portion may be present at the male coupling part as well as at the female coupling part. So, for example, may a bendable portion be formed at least by a portion of the female coupling part that projects beyond the upper edge of the respective side. Instead of working with a bendable portion, one may also work with a compressible portion, which then is compressed at least temporarily at least during the coupling action. This deformation or compression may at least partially relax at the end of the coupling action and, as a result of the volume increase of the respective portion of, for example, the male and/or the female coupling part, may take part in the obtained horizontal and/or vertical locking.

Preferably, according to all aspects of the invention, the coupling parts and locking portions are made such that, in a coupled condition of two of such floor elements, a locking exists that is operative in all directions of the plane perpendicular to the longitudinal direction of the coupled edges.

Further preferred forms of embodiment of the first through the seventh aspects will be described by means of the figures and the appended claims, and a further particular aspect of the invention will be explained as well.

BRIEF DESCRIPTION OF THE DRAWINGS

With the intention of better showing the characteristics of the invention, hereafter, as an example without any limitative character, several preferred forms of embodiment are described, with reference to the accompanying drawings, wherein:

FIGS. 21 and 22 illustrate methods with the characteristics of the sixth aspect of the present invention, wherein FIG. 22 represents a variant for the portion indicated by F22 in FIG. 21;

DETAILED DESCRIPTION OF PREFERRED EMBODIMENTS OF THE INVENTION

Figure 1:
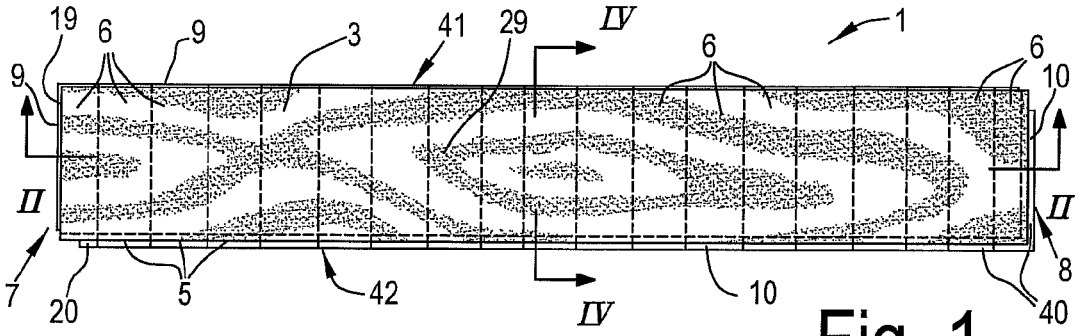
FIG. 1 represents a floor panel for composing a floor covering with, amongst others, the characteristics of the first, second, third, and fourth aspects of the present invention.

FIG. 1 represents a floor element 1 for forming a floor covering according to the invention. In this case, this relates to a rectangular and oblong floor element 1 that can be applied for composing a floor covering with, amongst others, the characteristics of the first, second, third and fourth aspects of the present invention.

Figure 2:
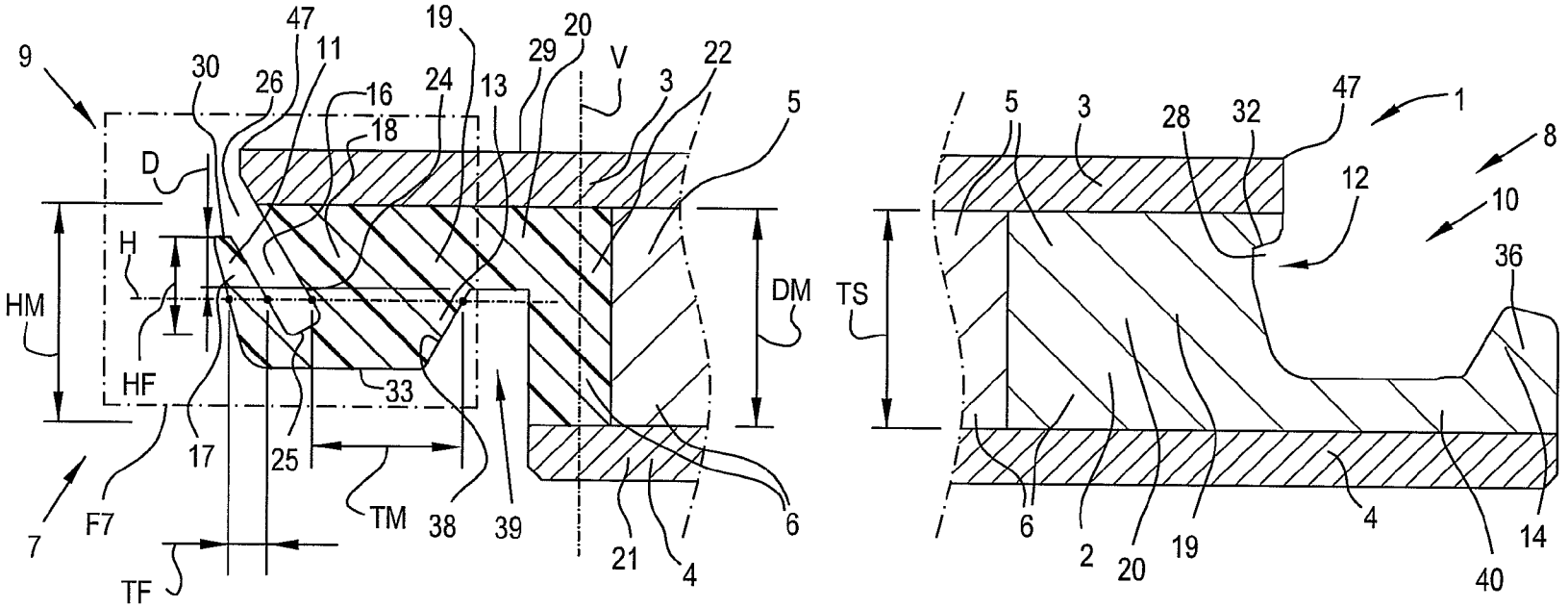
FIG. 2 in cross-section represents a view according to the line II-II indicated in FIG. 1.

As is illustrated by means of FIG. 2, the floor element 1 comprises a substrate 2, a top layer 3 and, in this case, also a backing layer 4. According to the invention, the top layer 3 and the backing layer 4 may consist of any material. So, for example, may the top layer 3 consist of wood, such as veneer or a layer of wood with a thickness from 1 to 15 millimeters, as it is the case here, and, in the case that a backing layer 4 is present, this backing layer 4 may also consist of wood. The represented floor element 1 relates to a floor element of the type that is better known under the denomination "prefabricated parquet" or "engineered wood". Such type of floor panel is also known, for example, from DE 203 10 959 U1 mentioned in the introduction. In this type of floor panel, the substrate 2 may comprise portions 5 consisting of wood or wood-based material, such as spruce wood or another type of softwood, chipboard, fiberboard, MDF or HDF. In the example of FIG. 1, these portions 5 are formed as laths 6 extending, adjacent to each other, with their longitudinal direction into the transverse direction of the floor element 1.

At a first pair of opposite sides 7-8, in this case the short sides, the floor panel has coupling parts 9-10, which can cooperate with each other and which substantially are made as a male coupling part 9 and a female coupling part 10. The coupling parts 9-10 are also provided with vertically active locking portions 11-12 and horizontally active locking portions 13-14.

Figure 3:
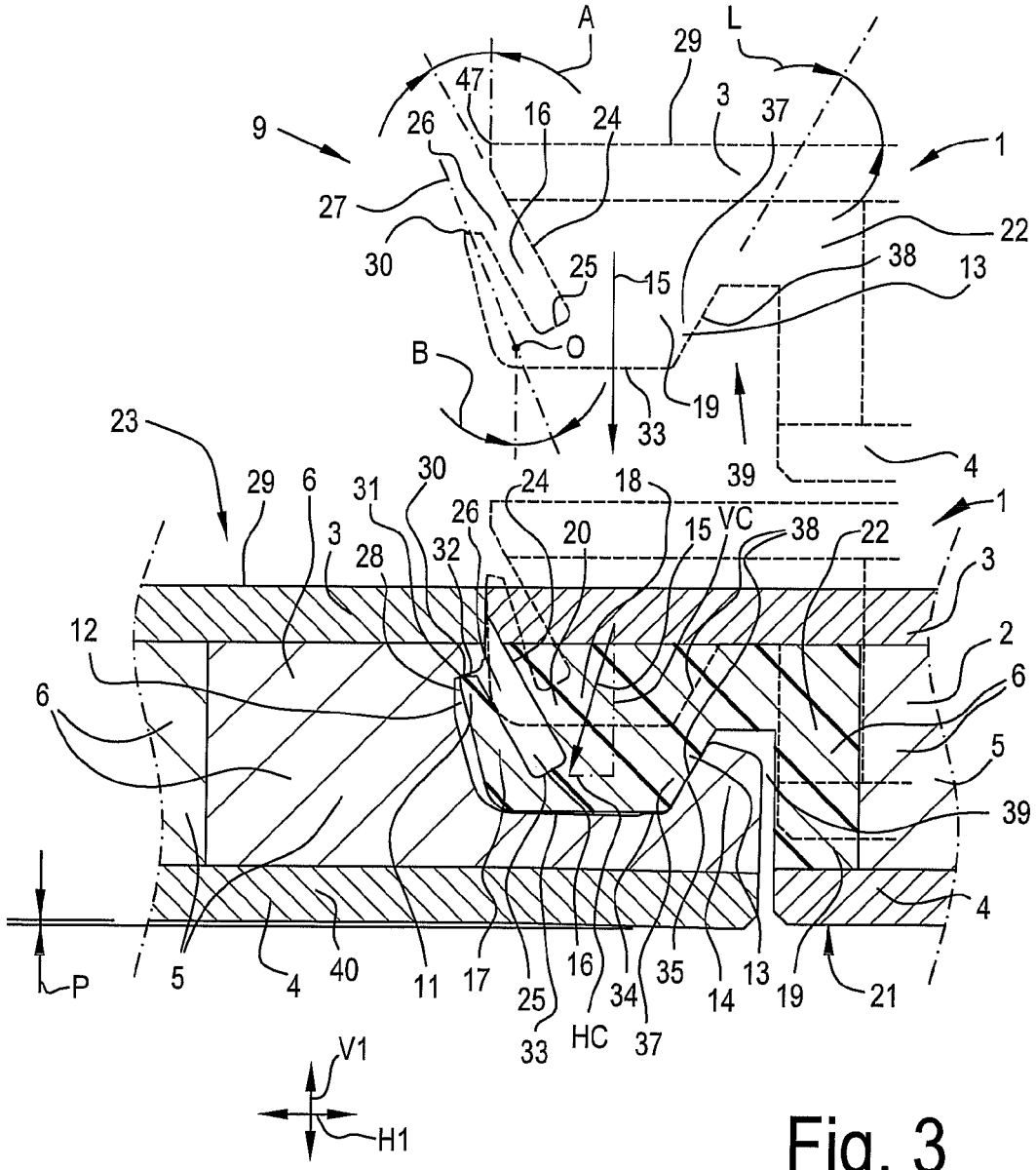
FIG. 3 represents the application of the floor panel from FIG. 1.

By means of these coupling parts 9-10 and associated locking portions 11-12-13-14, as FIG. 3 shows, two of such floor panels 1 can be interconnected by pushing one of these floor elements 1 with the associated male coupling part 9, by means of a downward movement 15, home into the female coupling part 10 of the other floor element 1 and, in the joined condition of two of such floor elements 1, a locking is obtained in a vertical direction V1 by means of the aforementioned vertically active locking portions 11-12, as well as in a horizontal direction H1 by means of the aforementioned horizontally active locking portions 13-14.

According to the first aspect, the floor element 1 of the example shows the particular characteristic that the male coupling part 9 has a downwardly directed recess 16, said recess dividing this coupling part 9 into, on the one hand, an upwardly directed bendable lip-shaped first portion 17 functioning as one of the aforementioned vertically active locking portions 11, and, on the other hand, a more massive second portion 18, wherein these portions 17-18 are made in one piece of one and the same material. As indicated in FIG. 2, the second portion 18 herein, over the majority of its height HM, viewed in a horizontal cross-section H, has a thickness TM that is larger than the thickness TF of the first portion 17, both aforementioned thicknesses TF-TM being measured in the same horizontal cross-section H. In the example, the second portion 18 over the majority of its height even is more than twice as thick as the first portion 17.

In this case, the aforementioned first portion 17 and second portion 18 are made in one piece in a separate edge portion 19, which is provided at the respective side 7 and is realized as an insert 20 in the actual substrate 2. Here, the separate edge portion 19, just like the remaining portions 5 of the substrate 2, is formed as a lath 6. Herein, the edge portion 19 forms the entire respective side 7 of the floor element 1, with the exception of the top layer 3 and the backing layer 4.

In general, according to all aspects of the present invention, it is preferable that the floor elements 1 have a substrate 2, said substrate 2 comprising portions 5 consisting of wood or wood-based material, such as spruce wood or another type of softwood, chipboard, fiberboard, MDF or HDF.

It is noted that, of course, it is not excluded that at the opposite side 8, on which the female coupling part 10 is formed, also a separate edge portion 19, such as an insert 20, can be present, upon which the female coupling part 10 then is formed at least partially and preferably entirely. The separate edge portions 19 or inserts 20 applied at both opposite sides 7-8 may be manufactured from the same as well as from a differing material. Preferably, at least one of both edge portions 19 consists of synthetic material. In the example of FIGS. 1 to 3, the side 7 having the male coupling part 9 comprises an insert 10 of synthetic material.

Apart from the dimensions of the separate edge portion 19 or insert 20, and apart from the thickness TF-TM of the first portion 17 and the second portion 18, the backing layer 4, which may be provided at the underside 21 of the floor elements 1, and/or the top layer 3, such as in this case, preferably extend at least partially underneath, above, respectively, the separate edge portion 19 or insert 20, or anyhow at least partially underneath, above, respectively, said second portion 18 of the male coupling part 9.

The floor element 1 represented in the FIGS. 1 to 3 may also be applied for forming a floor covering with the characteristics of the aforementioned second aspect of the invention. To this aim, the separate edge portion 19 has a basic portion 22, with which this edge portion 19 is seated in the actual floor panel 1, such that this basic portion 22 is bordered at the underside, in this case, by the backing layer 4, as well as at the upper side, in this case by the top layer 3, by the remaining material of the floor element 1. Viewed in the vertical section V through this basic portion 22 and the surrounding remaining material, the basic portion 22 extends over a distance DM being at least one half of the thickness TS of the substrate 2. In this case, viewed in the vertical section V, the substrate 2 is formed substantially, and in this case, entirely, by the aforementioned insert 20.

FIG. 3 clearly shows that with the respective floor element 1 or floor panel also a floor covering 23 may be formed with the characteristics of the third aspect of the invention. To this aim, the flank 24 of said recess 16, said flank being proximally situated in respect to the floor element, extends from the base 25 of the recess 16 towards the opening 26 thereof in an inclined manner towards the exterior edge of the floor panel 1. Herein, the acute angle A formed by this flank 24 with the vertical is more than 10° and less than 70°, namely 30°.

The acute angle B formed by the global center line 27 of the lip-shaped first portion with the vertical preferably is smaller than said angle A. A particularly good value for B lies in the order of magnitude of 15 to 25°. This order of magnitude for the angle B allows a smooth coupling by means of said downward movement 15.

As aforementioned, the here applied insert 20 at the side 7 having the male coupling part 9 consists of synthetic material, whereas the aforementioned female coupling part 10 is formed of another portion 5 of the substrate 2, preferably a wooden or wood-based portion 5 of this substrate 2. In such case, it is namely obtained that the floor element 1 or floor panel can also be applied for forming a floor covering 23 with the characteristics of the fourth aspect of the invention.

As also mentioned above, FIG. 3 clearly illustrates the coupling action by which two floor elements 1 can be mutually coupled by moving them in a downward direction towards each other, as indicated by arrows 15. As indicated, it is not excluded that said downward coupling movement 15 deviates from the vertical and has a horizontal component HC. According to the invention, however, the vertical component VC of the downward coupling movement 15 will dominate. When performing this coupling movement 15 with the floor elements 1 or floor panels of the example, the bendable lip-shaped first portion 17 performs a turning movement towards the second, more massive portion 18, in order to spring back entirely or partially at the end of the coupling action, in this case into an undercut 28 of the female coupling part 10, and wherein the lip-shaped first portion 17 and the undercut 28 then in this way function as said vertically active locking portions 11, 12, respectively. The turning point O of said turning movement preferably, as illustrated herein, is situated vertically underneath the upper surface 29 of the respective floor element 1.

FIG. 3 also shows that the cooperation of the vertically active locking portions 11-12, in this case the lip-shaped first portion 17 and the undercut 28, consists at least in that the bendable lip-shaped portion at its distal end 30 makes a contact 31 with a wall 32 of the female coupling part 10, namely the wall 32 bordering the undercut 28 towards the top.

The cooperation between both floor elements 1 in the floor covering 23 also results in the fact that at the underside 33 of the more massive second portion 18 a contact 34 is formed with the female coupling part 10. Also, a contact 35 is formed at the height of the horizontally active locking portions 13-14, which, in the present case, are performed as, on the one hand, an upright locking portion 36 at the female coupling part 10, and, on the other hand, a coupling portion 37 cooperating therewith at the male coupling part 9. Herein, the respective contact 35 takes place on a flank 38 of the locking portion 37 at the male coupling part 9. Preferably, this flank 38, at the height of the contact 35, is made with an inclination that forms an angle L with the horizontal, said angle differing from 90° and being larger than 45°. The larger the angle L is made, the sturdier the horizontal connection may be. The angle L illustrated here is 60°.

It is noted that in the example, the aforementioned horizontally active locking portion 13-37 of the male coupling part 9 forms part of the aforementioned more massive second portion 18 and is made in one piece with this second portion, in the same material, and thus, in this case, is made in the same separate edge portion 19 as the first portion 17 and the second portion 18.

Further, it is noted that, in the example of FIG. 2, the aforementioned flank 38 of the horizontally active locking portion 37 borders a recess 39. In such case, the distal end 30 of the lip-shaped first portion 17 most beneficially is situated in a horizontal plane extending at a distance D above the lowermost point of said recess 39. Preferably, this distance D is chosen between forty and seventy percent of the height HF of the lip-shaped portion 17. In the example represented here, the distance D is approximately one half of this height HF.

In principle, the aforementioned bendable lip-shaped first portion 17 may have any shape. Its thickness TF may vary in function of the height HF or remain constant. However, preferably the thickness TF of this portion 17 will decrease towards the distal end 30 thereof.

Further, it is possible that in the coupled condition of two floor elements 1, the projecting lip 40 bordering the female coupling part 10 towards the bottom is bent out over a small distance P. Due to the resiliency of this bent-out lip 40, a tension is created in the connection, said tension forcing the male coupling part 9 and the female coupling part 10 towards each other. Such tension is also known as a "pre-tension" and is described, for example, in WO 97/47834.

Figure 4:
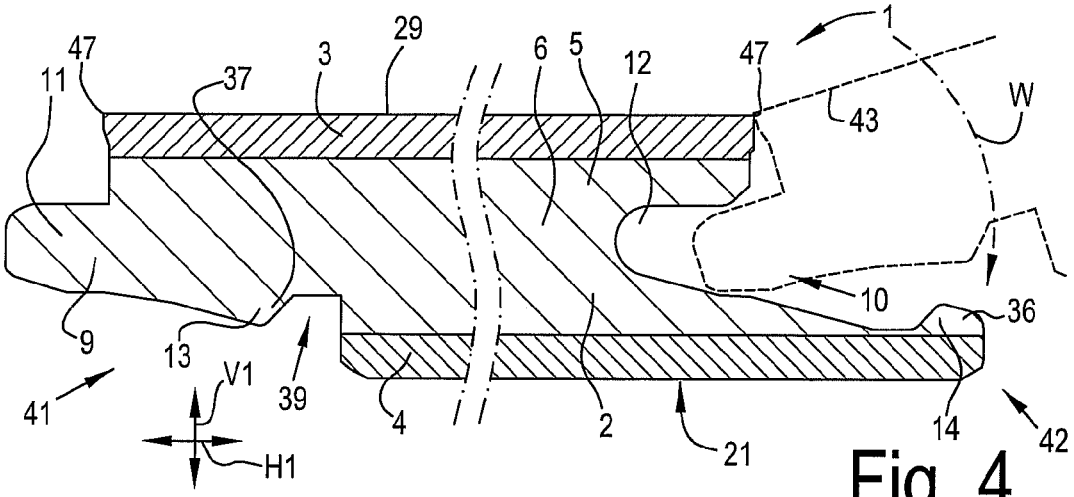
FIG. 4 in cross-section represents a view according to the line IV-IV indicated in FIG. 1.

FIG. 4 shows that, according to all aspects of the invention, also the second pair of opposite sides 41-42, in this case the long sides of the floor element 1 of FIG. 1, can be provided with cooperating coupling parts 9-10, which substantially are made as a male coupling part 9 and a female coupling part 10, which are provided with vertically active locking portions 11-12 and horizontally active locking portions 13-14. The illustrated coupling parts 9-10 and locking portions 11-12-13-14 are of the type as is known from the WO 97/47834 and allow that the floor elements 1 can be connected at this pair of sides 41-42 at least by providing one of these floor elements 1 with the associated male coupling part 9, by means of a turning movement W, in the female coupling part 10 of the other floor element 1, such as depicted with the dashed line 43. Other types of coupling parts and locking portions at the second pair of opposite sides 41-42 of a floor element 1 according to the invention are possible. So, for example, it is possible to favor coupling parts and locking portions that allow that the floor elements can be connected to each other at least by shifting them towards each other in the horizontal direction H1, or which allow that the floor elements can be connected to each other at least by moving them towards each other in a downward, substantially vertical direction V1. In this latter case, it is possible to choose at the second pair of opposite sides 41-42 coupling parts and locking portions that have characteristics identical to those of the coupling parts 9-10 and locking portions 11-12-13-14 of the first pair of opposite sides 7-8.

Figure 5:
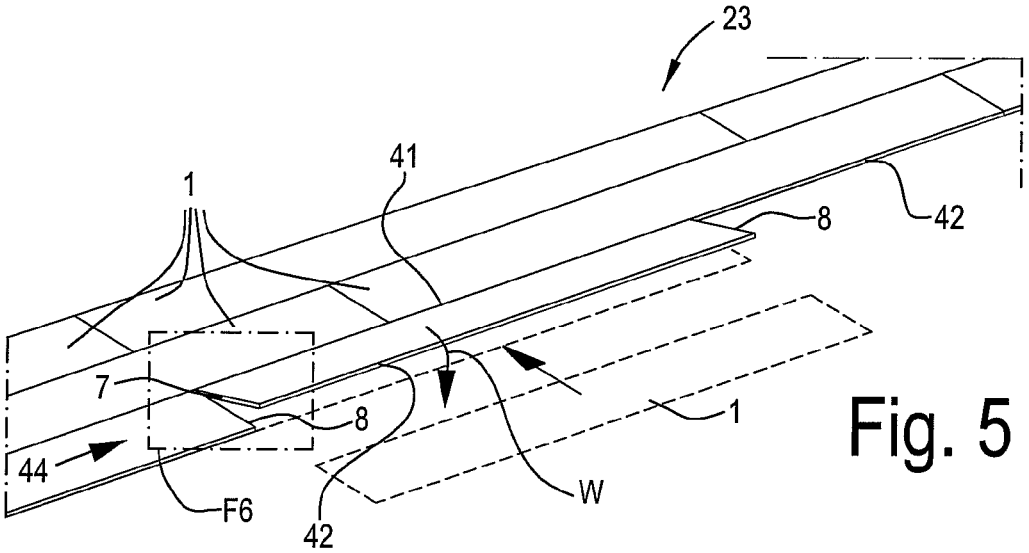
FIGS. 5 to 7 further illustrate the application of the floor panel from FIG. 1, wherein FIG. 6, at a larger scale, represents a view of the portion indicated by F6 in FIG. 5, and FIG. 7, also at a larger scale, represents a view of the portion indicated by F7 in FIG. 2.
Figure 6:
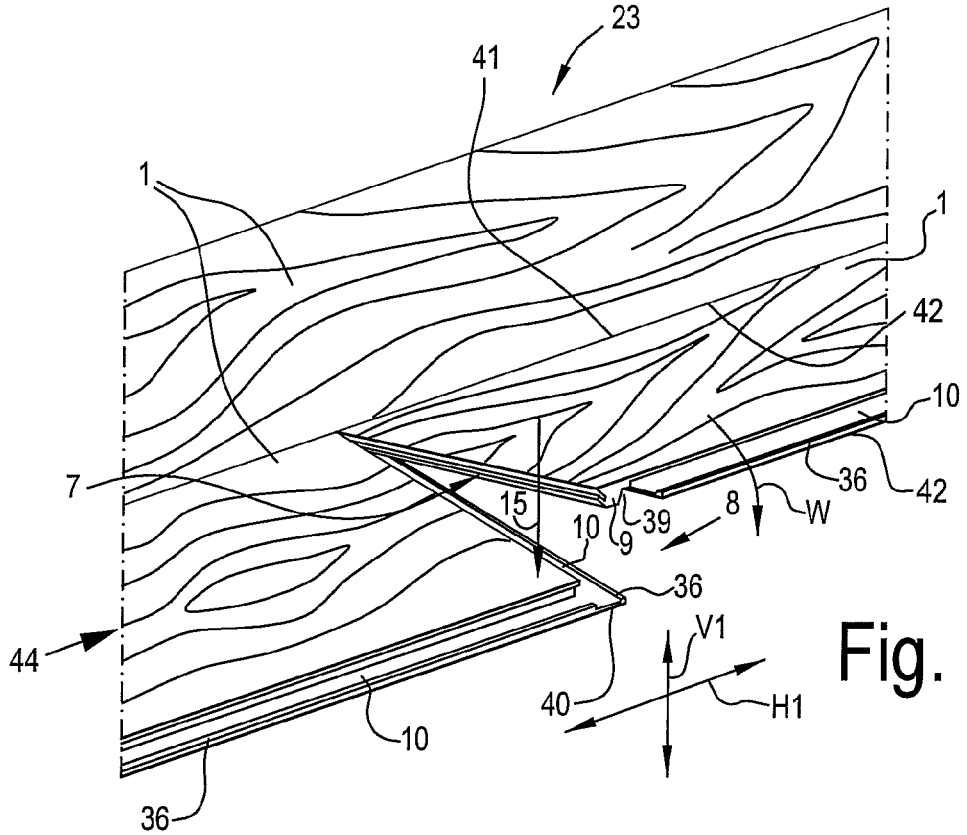

As FIGS. 5 and 6 indicate, the possibility of connecting the floor elements 1 at their second pair of opposite sides 41-42 by turning them into each other enables a fast and simple installation. In such case, the user only has to perform a single movement, namely the turning movement W, with the floor elements 1. Namely, by turning the floor element 1 into each other at said second pair of opposite sides 41-42, automatically a downward movement 15 is obtained at the first pair of sides 7-8, whereby these, too, are coupled. By means of this downward movement 15, the male coupling part 9 of the respective floor element 1 can be pushed home into the female coupling part 10 of a floor element 1 already installed in the same row 44. The user only has to provide for that the male coupling part 9 is situated at the first pair of opposite sides 7-8 above the female coupling part 10. It is noted that in the case of floor coverings 23 with the characteristics of the present invention, this positioning of the male coupling part 9 is not so critical, as the inventors have found that, at the end of the coupling action, it is possible that the male coupling part 9, to a limited extent, in the horizontal direction HI automatically pulls itself into the female coupling part 10.

Figure 7:
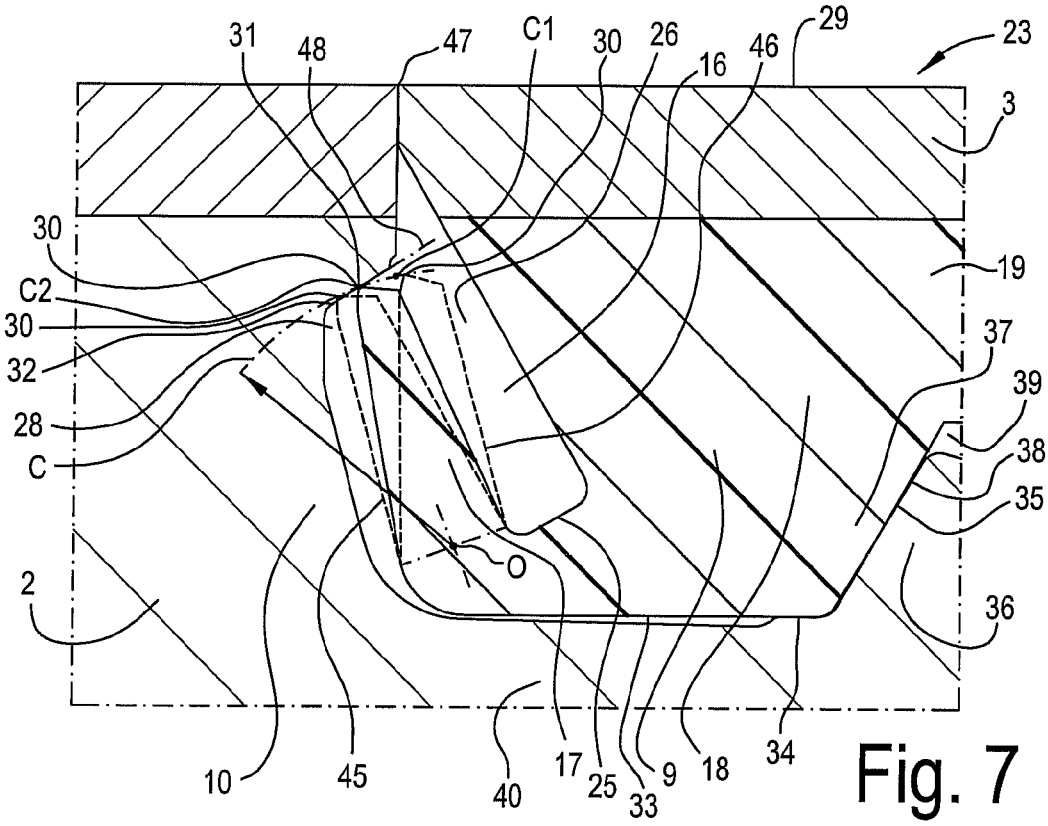

FIG. 7 illustrates that the bendable lip-shaped first portion 17, in a preferred form of embodiment of the invention according to all of its aspects, in the connected condition of two of such floor elements 1, has sprung back only partially and remains standing against the wall 32 bordering said undercut 28 of the female coupling part 10 in upward direction. In dashed lines 45-46, in FIG. 7 the position of the first portion 17 respectively before and during the coupling action is represented. As the lip-shaped first portion 17 in the coupled condition, which is represented in full line, has sprung back only partially, a clamping effect of the coupling is provided, such that then a good vertical locking is obtained. Such clamping effect may best be obtained by performing the aforementioned wall 32 bordering the undercut 28 in upward direction with an inclination, and preferably performing it such that the turning circle C of the first lip-shaped portion 17, or the curve describing the possible positions of the distal extremity 30 of this lip-shaped first portion 17, on the one hand, has at least a first point C1, which, viewed in the vertical plane through the upper edge 47 of the floor panel, is situated underneath the aforementioned wall 32 or the extension 48 thereof, and, on the other hand, has at least a second point C2, where said curve or turning circle C intersects said wall 32. As already mentioned above, the turning circle C of the circle approaching the turning curve preferably, as herein, has a center O situated vertically underneath the upper surface 29 of the respective floor element 1.

Figure 8:
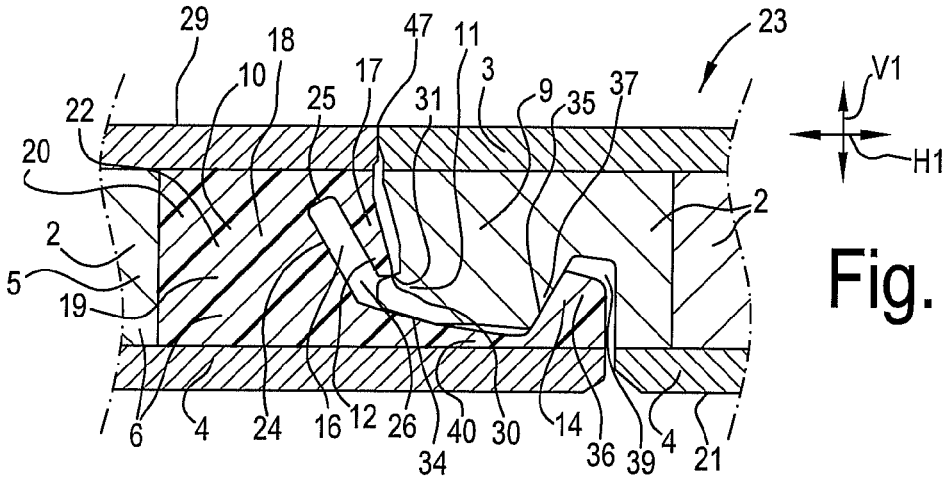
FIGS. 8 to 15 represent variants of the floor panel from FIG. 1, wherein FIG. 14 at a larger scale represents a view on the portion indicated by F14 in FIG. 9.

FIG. 8 shows a variant with the characteristics of the third and the fourth aspect of the invention. Herein, contrary to floor coverings 23 with the characteristics of, for example, the first and/or the second aspects, the coupling part having said recess 16 is the female coupling part 10, and said recess 16 is directed upward, whereas the bendable lip-shaped first portion 17 is directed downward.

The female coupling part 10 and its associated locking portions 12-14 are performed on a separate edge portion 19, such as an insert 20, in this case made of synthetic material, whereas the male coupling part 9 is entirely formed in a wooden or wood-based portion 5 of the actual substrate 2.

It is noted that the female coupling part 10 of the example preferably is fabricated by means of an extrusion technique.

Figure 9:
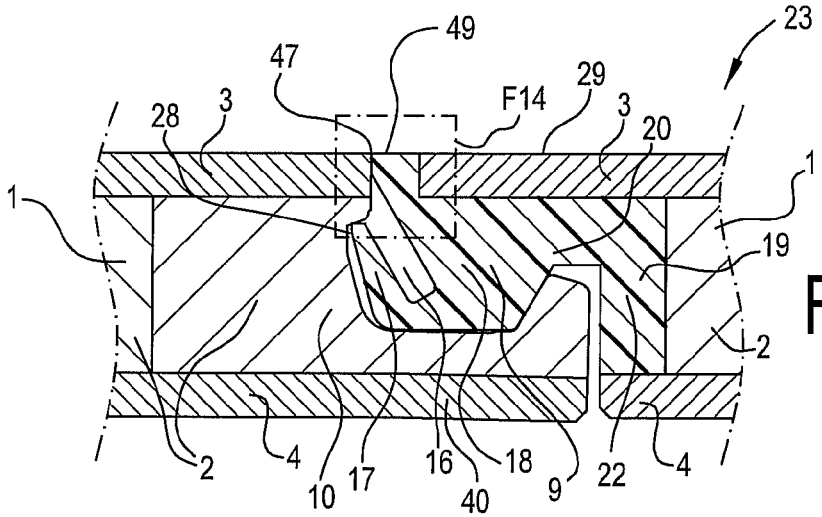

FIG. 9 shows a variant, wherein said separate edge portion 19 or insert 20 remains visible at the upper surface 29 of the floor covering 23 after coupling two of such floor elements 1. There, the insert may, for example, fulfill a decorative function, such as imitating a cement joint or a rubber strip 49, such as with the imitation of ships' decks. However, it is not excluded that the insert 20 at the upper surface 29 also fulfills a technical function, for example, the function of a seal counteracting the penetration of water into the connection.

It is noted that in the example of FIG. 9, the separate edge portion 19 forms the entire respective side 7 of the floor element 1, with the exception of the backing layer 4.

Figure 10:
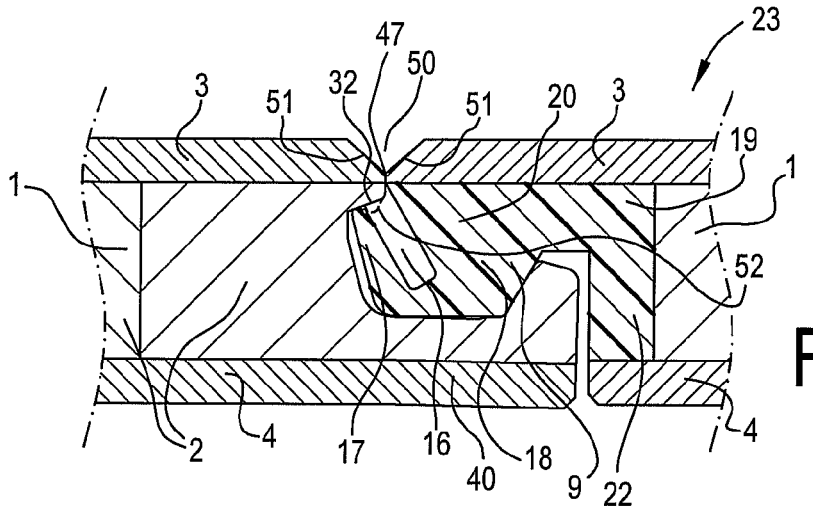

FIG. 10 shows another variant, in which, at the upper edges 47 of the floor elements 1, a material portion 50 has been removed in order to form a chamfer 51, in this case, a bevel. Such chamfer 51 may also continue as far as into the substrate 2 or the separate edge portion 19, and may possibly be covered with a separate decorative layer. Here, an embodiment with a covered chamfer is not represented. However, chamfers 51, which are provided with a separate decorative covering, are known those skilled in the art, for example, from WO 01/96689.

A further variant is represented in dashed line 52 in FIG. 10, wherein the first lip-shaped portion 17 also functions as a horizontally active locking portion, whether or not in a limited manner.

Figure 11:
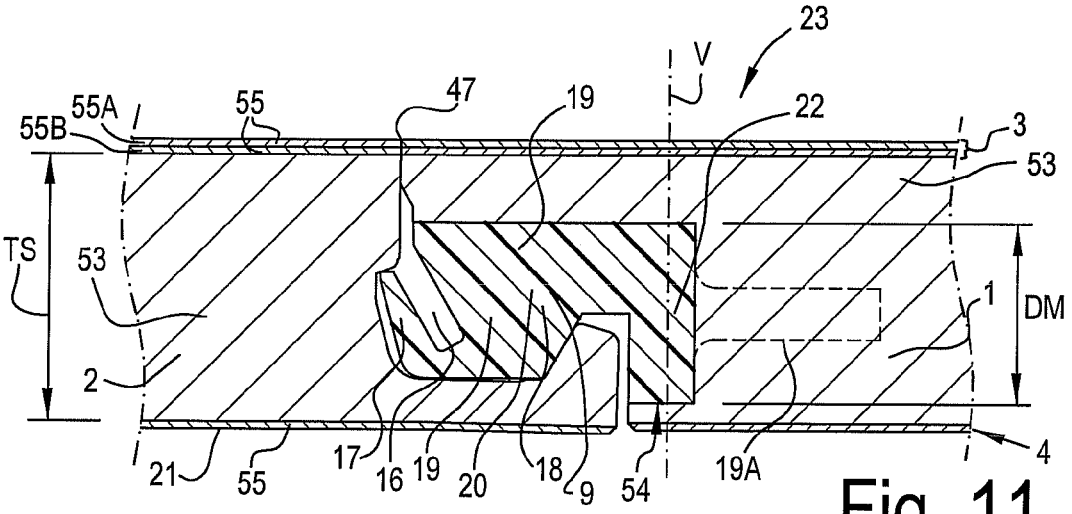

FIG. 11 represents another preferable form of embodiment of the first through the fourth aspects of the invention. This relates to a floor covering 23, which is composed of floor elements 1, the substrate 2 of which is formed of a board 53 of, for example, MDF or HDF, whether or not already provided with a top layer 3 and/or backing layer 4, where at least at one of two opposite sides 7-8, and preferably at both opposite sides of that pair, material has been removed and said separate edge portion 19 forms part of a material part situated in the obtained groove-shaped recess 54 in the edge of the substrate 2. The separate edge portion 19 is, for example, glued into the substrate 2 as an insert 20, or is formed within the groove-shaped recess 54 by means of an injection molding technique. In dashed line, also a variant 19A for the separate edge portion 19 is represented, having an attachment portion with which it can be integrated even sturdier into the substrate 2.

The form of embodiment of FIG. 11 is particularly suited for laminate floor panels manufactured by means of a DPL (Direct Pressure Laminate) process. With such floor panels, the top layer 4, as represented here, is constructed of carrier sheets 55, for example, paper sheets, immersed in synthetic material or resin, which are consolidated in a heated press with a board material 53, such as an MDF or HDF board. At the underside 21 of the board material 53, also a carrier sheet 55 immersed in synthetic material or resin is provided as a backing layer 4 by means of the same press treatment. The board 53 obtained by means of the press treatment then is divided into panels having approximately the size of the final floor panels or floor elements 1. Preferably, it is in these panels 1 that, as aforementioned, material is removed from the board material in order to form the groove-shaped recess 54, in which the separate edge portion 19-19A is realized, preferably as an insert 20.

One of the aforementioned carrier sheets 55 that are situated at the upper side 29 of the floor element, is a decorative layer 55A with a printed décor, which, for example, represents a wood pattern. This decorative layer 55A is protected against wear and/or scratching by means of a wear-resistant layer 55B, which latter also comprises such resin-immersed carrier sheet 55, and is known better under the denomination of an overlay. The wear resistance of this latter carrier sheet 55B may have been obtained, for example, in that it contains hard particles, such as aluminum oxide and/or silicon carbide.

As aforementioned, the form of embodiment of FIG. 11, amongst others, has the characteristics of the second aspect. Viewed in the vertical section V, the basis portion 22 of the separate edge portion or insert 20 extends over a distance DM that is more than one half of the thickness TS of the substrate 2. In this vertical section V, the separate edge portion 19, at its underside as well at its upper side, is bordered by the actual substrate 3, which, in this case, relates to the board-shaped material 53.

Figure 12:
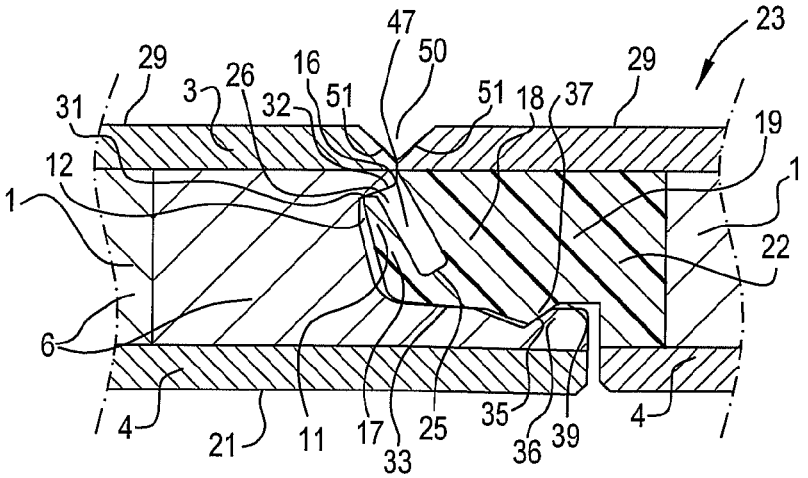

FIG. 12 represents another variant, wherein the recess 39, which is bordered by the horizontally active locking portion 37 in the male coupling part 9, has only a limited depth. Herein, the deepest point of this recess 39 is situated in an horizontal plane situated below the deepest point of the recess 16 in the separate edge portion 19. In this manner, a particularly massive second portion 18 is obtained.

Figure 13:
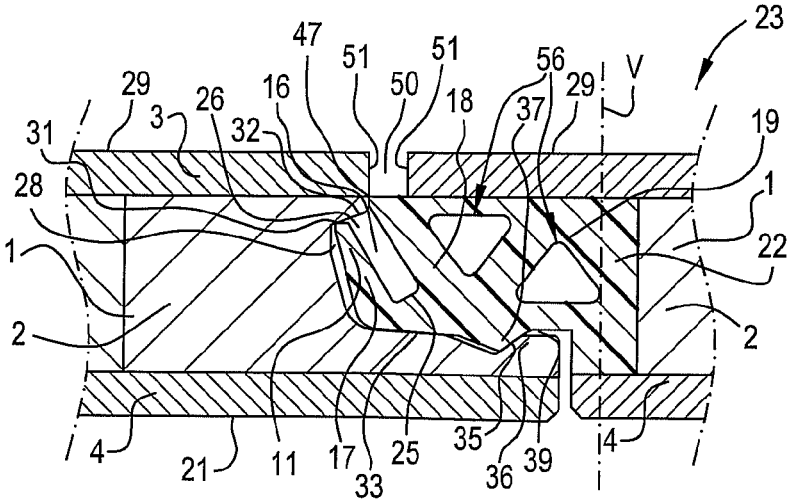

FIG. 13 shows a variant, in which the separate edge portion 19 has a hollow structure 56; however, the aforementioned second portion 18 still acts more massive compared to the lip-shaped first portion 17.

Figure 14:
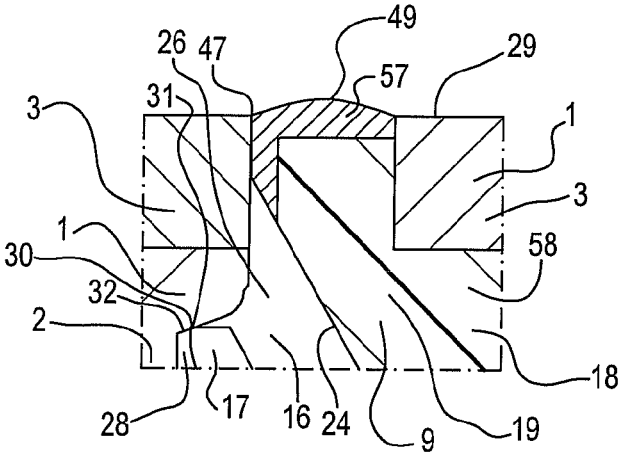

FIG. 14 shows a possible application of a co-extruded separate edge portion 19 or insert 20. In the example, the separate edge portion 19 consists of, on the one hand, a first material 57 with which the separate edge portion 19 adjoins against the adjacent floor element 1, and which, after coupling two of such floor elements 1, also remains visible at the upper surface 29, and, on the other hand, of a second material 58 that has been extruded together with the first material 57 and forms the remaining portion of the separate edge portion 19. For the first material 57, for example, a rubber can be chosen, such that a good protection against the penetration of moisture into the connection is obtained, whereas for the second material 58 a synthetic material on the basis of polyurethane can be chosen, which, as mentioned herein above, is extremely suited for realizing milled profiles. Of course, it is not excluded that in such co-extruded separate edge portion 19 more than two materials are combined. It is noted that co-extrusion may also be performed in filled synthetic material composites, such as extruded wood.

Figure 15:
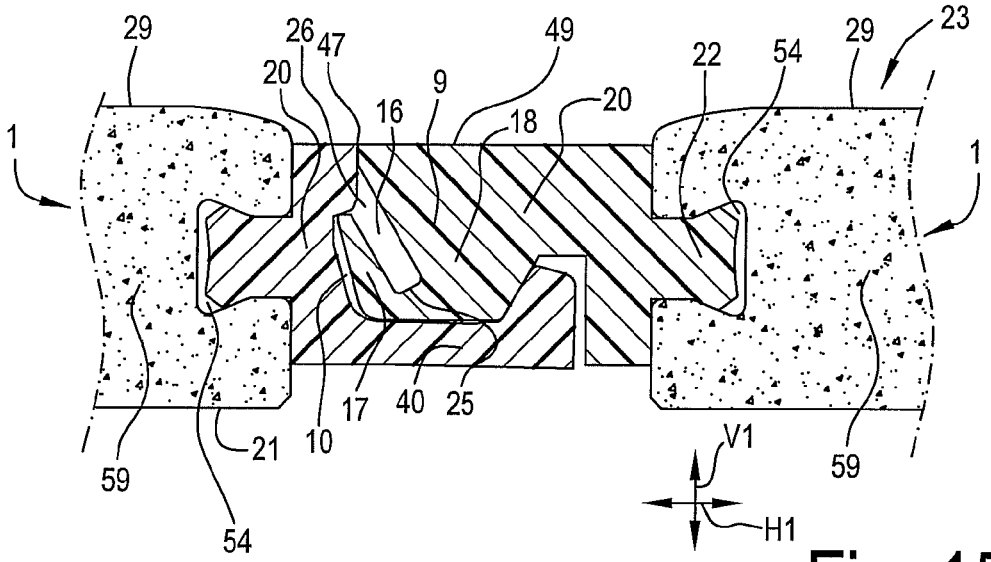

FIG. 15 shows a variant of a floor covering 23 with the characteristics of, amongst others, the first and the third aspect of the invention. The floor elements 1 represented here relate to floor elements formed as tiles and comprising a decorative element 59 of a stone-like material, such as real ceramics. At both sides of at least a first pair of opposite sides 7-8 of the floor elements, a separate edge portion 19 of synthetic material is provided. To this aim, in the example, groove-shaped recesses 54 are provided at the decorative element 59, in which the respective separate edge portion 19 can be provided, in this case by means of a snap-on coupling. According to a not-represented variant, such decorative element 59 also may be at least partially encapsulated by means of synthetic material, such as polyurethane, or filled synthetic material composite, such as extruded wood. With such encapsulation, preferably at the underside of the decorative element 59 a bottom is formed and at least at one side and preferably at all sides an edge portion is formed, in which then coupling parts may be provided, for example, by means of a milling process.

FIGS. 16 through 20 represent floor coverings 23 with the characteristics of the fifth aspect of the invention, mentioned in the introduction.

Figure 16:
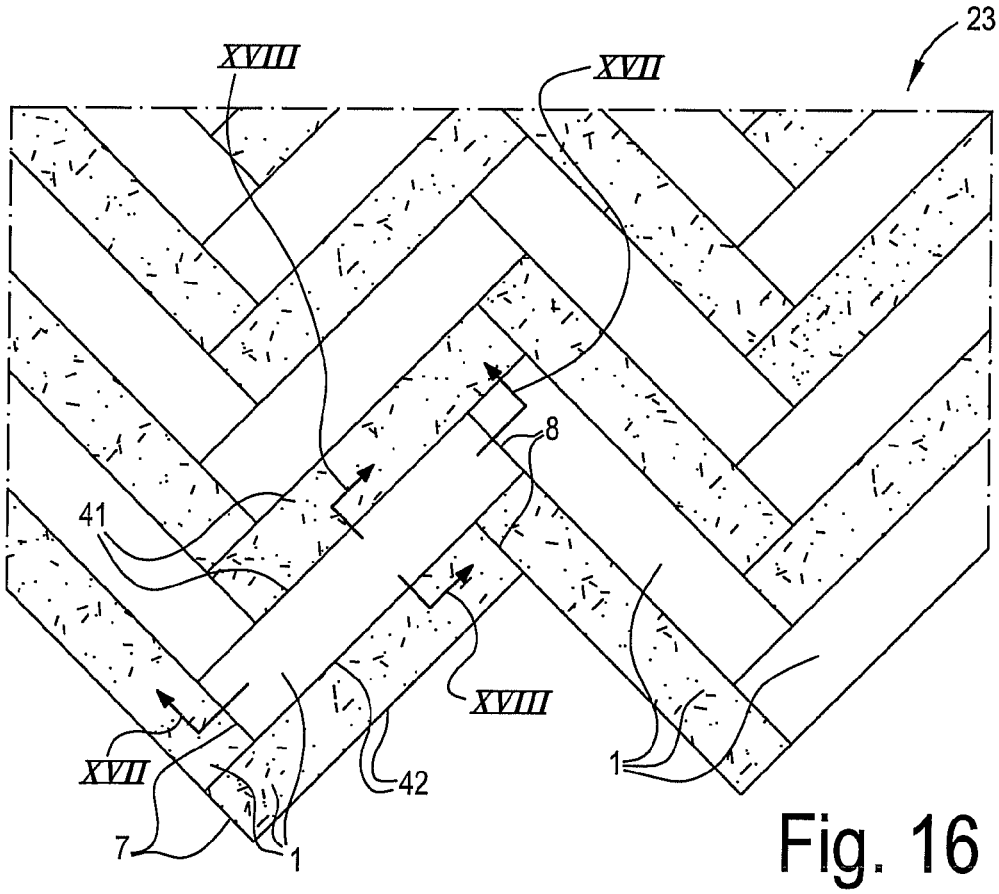
FIGS. 16 to 18 represent a floor covering with the characteristics of the fifth aspect, wherein FIGS. 17 and 18 respectively represent a view according to the lines XVII-XVII and XVIII-XVIII, as indicated in FIG. 16.

The example of FIG. 16 relates to a floor covering 22 composed in a herringbone pattern.

Figure 17:
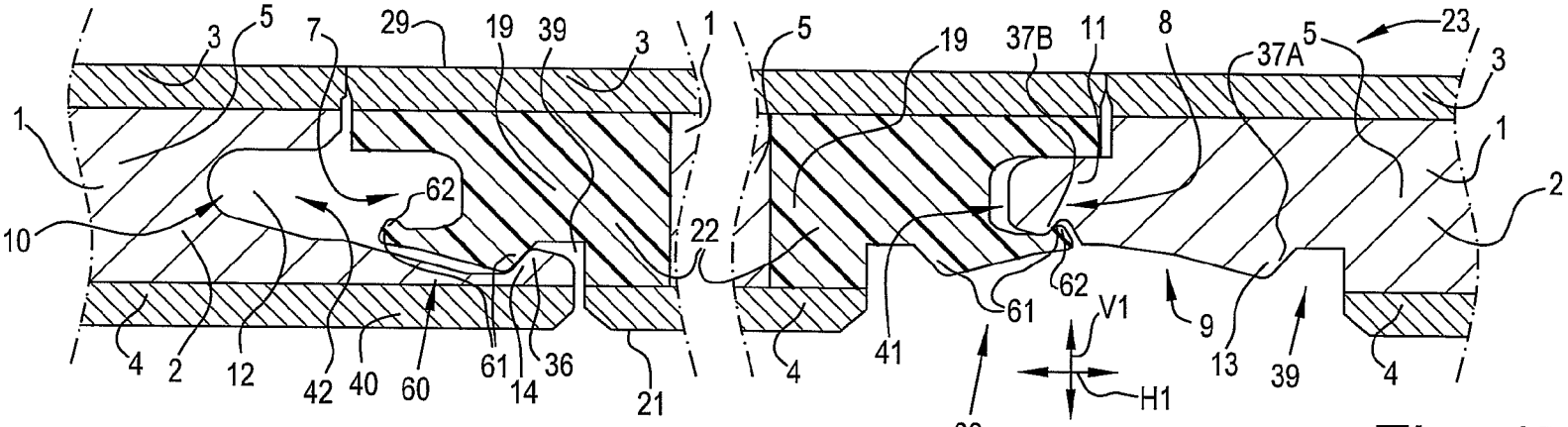
Figure 18:
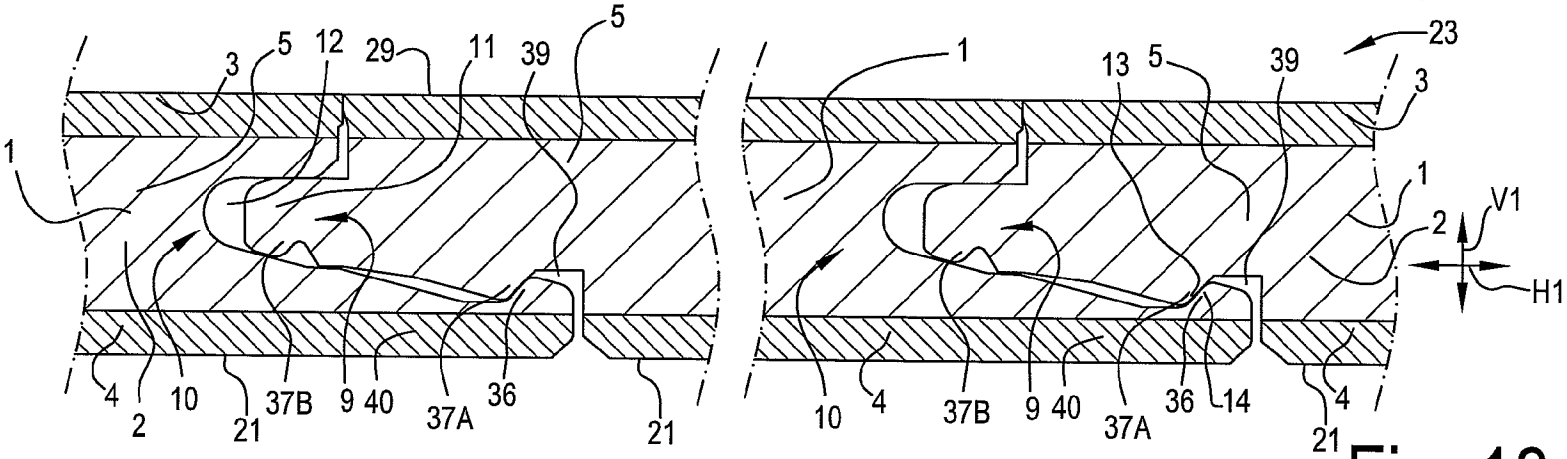
Figure 19:
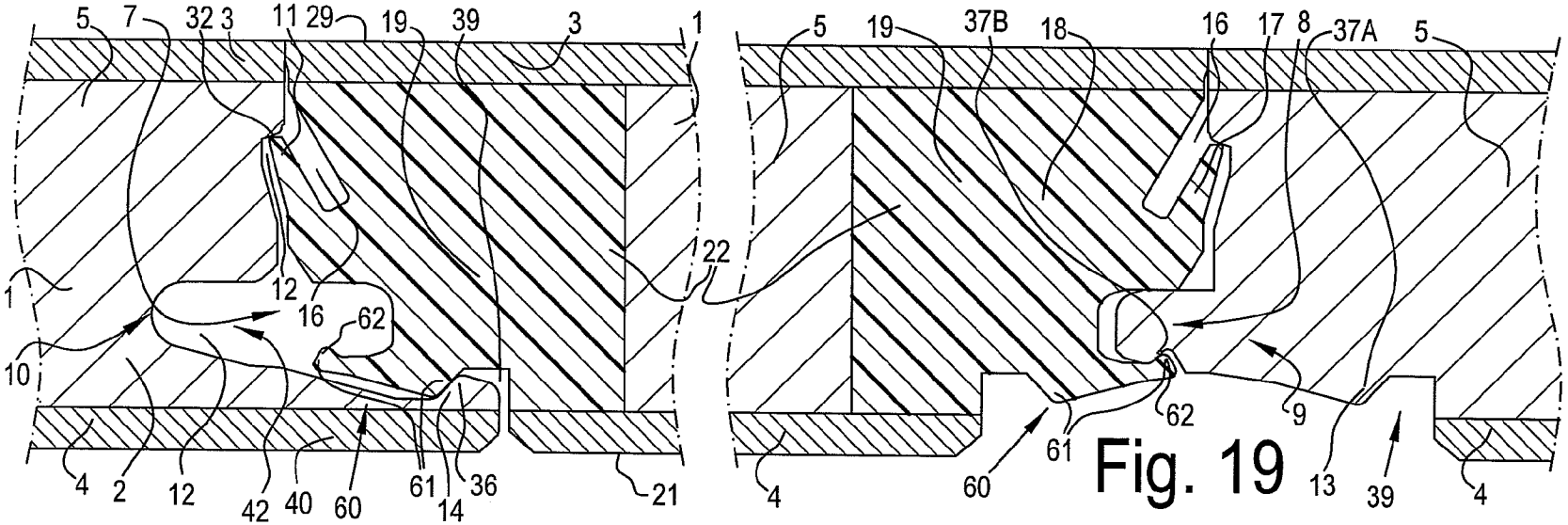
FIGS. 19 and 20 represent a variant of such floor covering in views similar to those of FIGS. 17 and 18.
Figure 20:
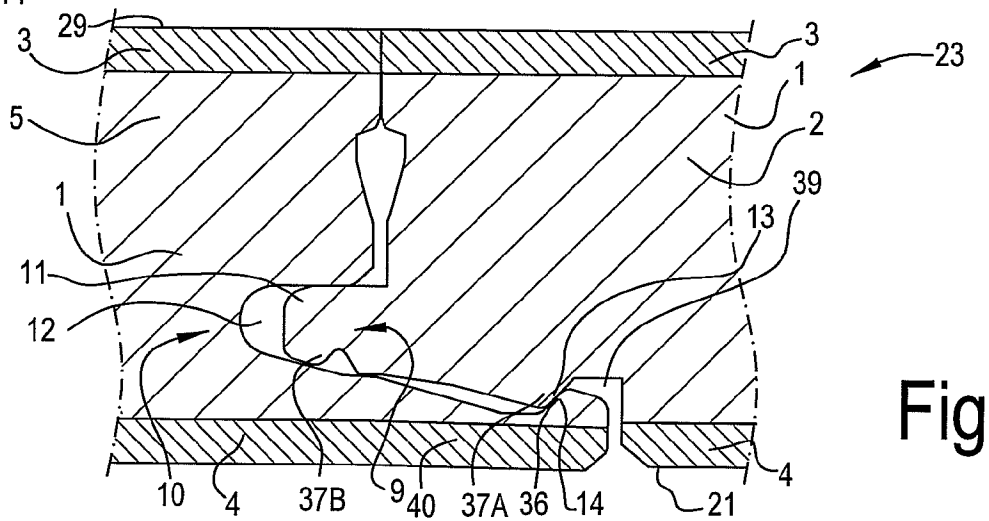

As represented in the FIGS. 17 and 18, the floor elements of the floor covering 23 of FIG. 16 comprise coupling parts at a first pair of opposite sides 7-8, namely, at the short sides, as well as at a second pair of opposite sides 41-42, namely at the long sides of the floor elements 1. The coupling parts 9-10 of the pair of opposite long sides 41-42 substantially are performed as a male coupling part 9 and a female coupling part 10, which, as is illustrated in FIG. 18, may cooperate with the female coupling part 10 and the male coupling part 9, respectively, of the opposite long sides 41-42 of an identical floor element. The coupling parts 60 of both opposite short sides 7-8 of the floor elements 1, as is illustrated in FIG. 17, are designed such that each of these coupling parts 60 can cooperate with the male coupling part 9, as well as with the female coupling part 10 of opposite long sides 41-42 of an identical floor element 1.

The particularity of the floor elements represented in the FIGS. 17 and 18 consists in that the coupling parts 60 situated at the opposite short sides 7-8 of the floor elements 1 are made at least partially and preferably entirely of a synthetic material, such as a filled synthetic material composite or any other synthetic material, such as, for example, polyurethane. At both sides of a first pair of opposite sides 7-8 of the floor elements 1, in this case, the short sides, a separate edge portion 19 or insert 20 of synthetic material is provided in the substrate 2. Herein, in the example, the separate edge portions 19 or inserts 20 form the entire respective sides 7-8 of the floor elements 1, with the exception of the top layer 3 and the backing layer 4. On the separate edge portions 19, coupling parts 60 and/or locking portions 61 are formed, which can cooperate with the coupling parts 9-10 and/or the locking portions 11-12-13-14 of both sides 41-42 of the second pair of opposite sides. Preferably, the coupling parts 60 and locking portions 61 at the first pair of opposite sides 7-8, as illustrated herein, are made identical, whereas the coupling parts 9-10 at the second pair of opposite sides 41-42 substantially are made as a tongue at the side 41 having the male coupling part 9 and a groove at the side 42 having the female coupling part 10. The mutual cooperation among the coupling parts 9-10 of the second pair of opposite sides 41-42 is represented in FIG. 18.

In the example of the FIGS. 17 and 18, the aforementioned tongue is provided with two locking elements 37 at its underside, namely, on the one hand, a first locking element 37A situated proximally in respect to the respective floor element 1 and allowing the tongue to cooperate with an upright locking portion 36 of the female locking part 10 or the groove at the opposite side 42, and, on the other hand, a second locking element 37B allowing the male coupling part 9 or the tongue to cooperate with one of the upright locking elements 62 of the first pair of opposite sides 7-8.

Herein, it is noted that, in the example of the FIGS. 17 and 18, in the cooperation of one side of the first pair of opposite sides 7-8 with the female coupling part 10 or the groove of the second pair of opposite sides 42, solely a locking in the horizontal direction H1 is achieved, whereas in a cooperation of that side with the tongue of the second pair of opposite sides a locking in the horizontal direction H1 as well as in the vertical direction VI is achieved.

In a similar view as that of FIGS. 17 and 18, FIGS. 19 and 20 show that it is not excluded to provide coupling parts 60 and locking portions 61, which, when cooperating with a male coupling part 9 as well as with a female coupling part 10, effect a locking in the horizontal direction H1 as well as in the vertical direction V1. In the example, use is made of a bendable lip-shaped portion 17, which, as in the examples of FIGS. 2, 3, and 7 through 15, functions as a vertically active locking portion and is obtained in that a recess 16 divides the respective coupling part 60 or the separate edge portion 19 on which this coupling part 60 is provided, into this lip-shaped bendable first portion 17 and a second portion 18, which in this case is made more massive than the first portion 17. It is clear that the illustrated coupling parts 60 and locking portions 61 also have or may have other features in common with those of the aforementioned figures and that these features here, too, are useful.

Figure 21:
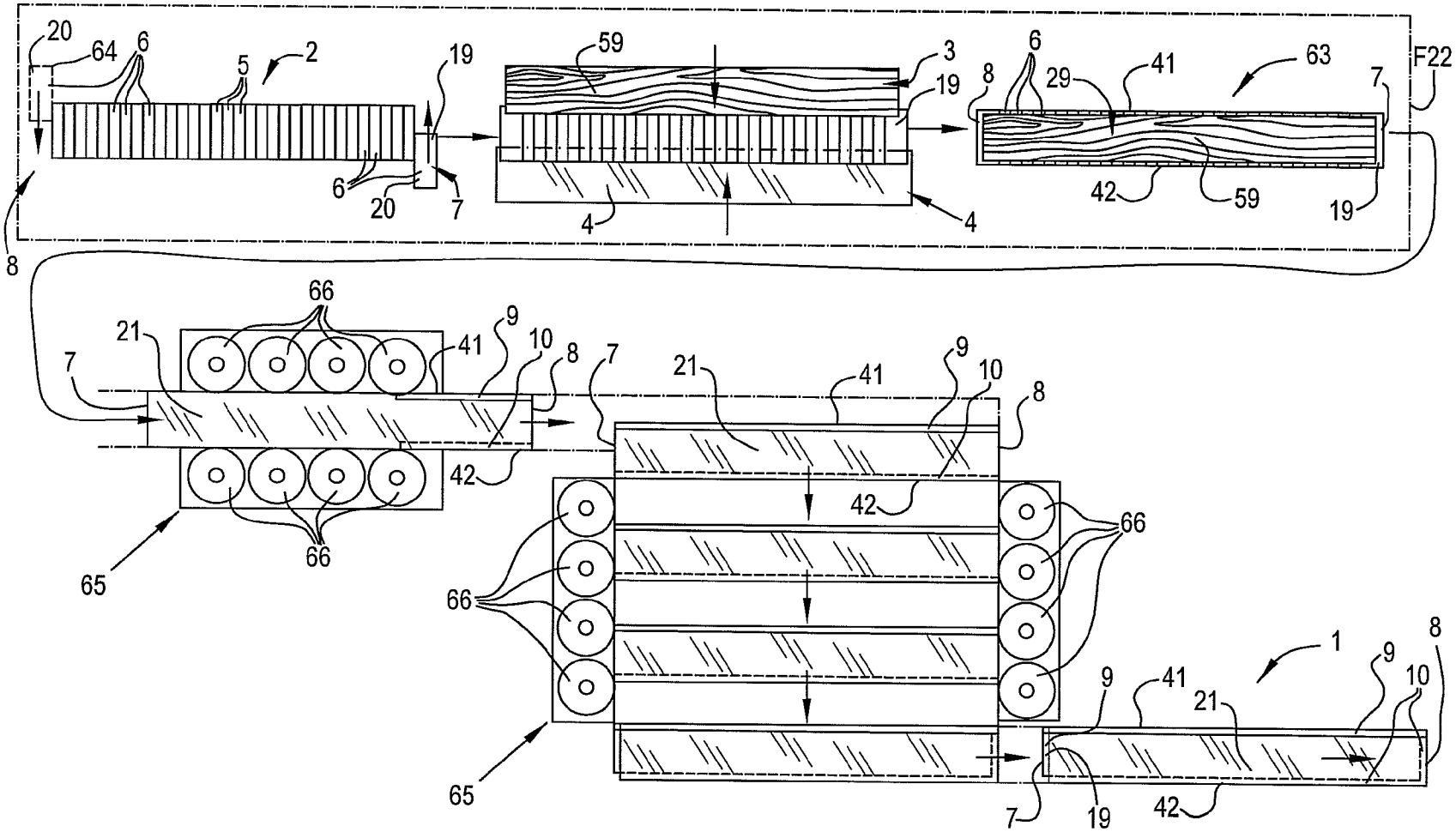

FIG. 21 illustrates several steps of a method with the characteristics of the sixth aspect of the invention. This relates to a method for manufacturing floor elements 1, which comprise a decorative element 59 and have coupling parts at least at two opposite sides, and in this case at all opposite sides. In the example of FIG. 21, the decorative element 59 relates to a decorative element 59 in the form of a wooden top layer 4 defining the upper surface 29 of the floor element 1.

More particularly, the method relates to a method for manufacturing floor panels or floor elements 1 of the type represented in FIG. 1, with an actual substrate 2 comprising wooden or wood-based portions 5, with a top layer 3 and a backing layer 4 of wood and a separate edge portion 19 of synthetic material, said edge portion being provided at least at one side 7. It is noted that, globally seen, the floor element 1 is constructed of another material than the synthetic material of the separate edge portion 19.

According to the sixth aspect, the method comprises at least a step in which a semi-finished product 63 is produced, which comprises at least said edge portion 19 and said decorative element 59.

In the example, the semi-finished product 63 is produced by bringing together wooden or wood-based laths 6 and the aforementioned separate edge portion 19 of synthetic material and providing the decorative element 59 as a top layer 3 on these laths 6 and edge portion 19, wherein preferably, as represented herein, also a backing layer 4 is provided underneath said laths 6 and edge portion 19. In this case, the separate edge portion 19 relates to an insert 20 also in the form of a lath 6. As indicated by the dashed line 64, it is not excluded that both opposite sides 7-8 are provided with a separate edge portion 19 or insert 20, wherein then it is possible that both edge portions 19 consist of synthetic material, however, it is not excluded that solely one thereof is an edge portion 19 or insert 20 of synthetic material, whereas the other edge portion 19, for example, is an edge portion consisting of a wood or wood-based material, such as MDF or HDF, preferably also in the form of a lath 6.

It is noted that combining wooden or wood-based laths 6 with, for example, an insert 20 of MDF or HDF is known to manufacturers of the type of floor elements mentioned in the introduction, which is known by the denomination of "engineered wood" and described, amongst others, in DE 203 10 959 U1. However, the inventors have found that by inserting an insert 20 of synthetic material instead of an MDF insert, a plurality of new possibilities is created. So, for example, the floor elements 1 of floor panels mentioned in connection with the first through the fifth aspects can be manufactured in a smooth manner on similar or even on the same machines already applied by existing manufacturers of floor elements 1 or floor panels. These manufacturers do not need to provide special machines. Preferably, however, care is taken when choosing the synthetic material that the dust created by the machining treatment of the sixth aspect can be mixed with the dust occurring as a result of a possible machining treatment of the remainder of the floor element, such that the waste streams remain governable in a simple manner. Ideally, in respect to governing the waste streams, extruded wood may applied as a synthetic material. Moreover, such material may be processed by means of the same or similar tools as wood or wood-based materials, such as MDF or HDF.

Further, it is noted that by means of such method also a floor element 1 can be formed of the type "dual layer parquet" or "Zweischichtparkett". For forming such floor element 1, said backing layer may be omitted, such that the obtained floor element 1 substantially consists of said laths 6, insert 20 and top layer 3.

As aforementioned, these new possibilities show their advantages in particular with coupling parts 9-10 and locking portions 11-12-13-14 allowing interconnecting two floor elements 1 by means of a downward movement 15.

After the semi-finished product 63 has been provided, the step of performing a machining treatment takes place at the separate edge portion 19 of the already formed semi-finished product in order to fabricate at least a portion of the coupling part 9-10-60 to be formed therein. To this aim, in the example, the obtained semi-finished product 63, with its underside 21 directed upward, is conveyed through two edge profiling machines 65 and is provided with coupling parts 9-10-60 and/or locking portions 11-12-13-14-61 at its opposite long sides 41-42, as well as at its opposite short sides 7-8, by means of a milling process being said machining treatment. Milling treatments at the edges of floor elements 1 are described, for example, in detail in the aforementioned WO 97/47834. The mechanical tools applied for the machining treatment preferably relate to rotating milling tools 66.

Figure 22:
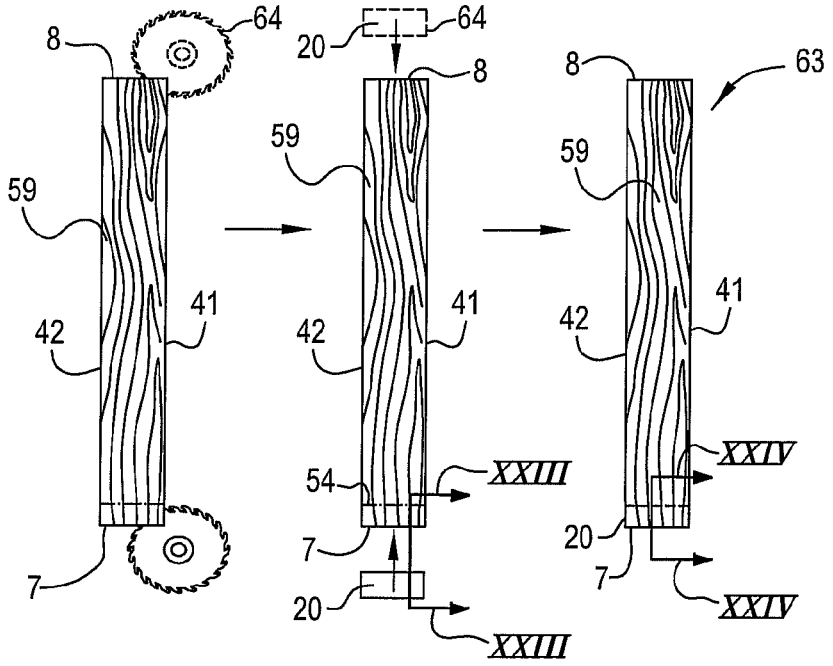
Figure 23:
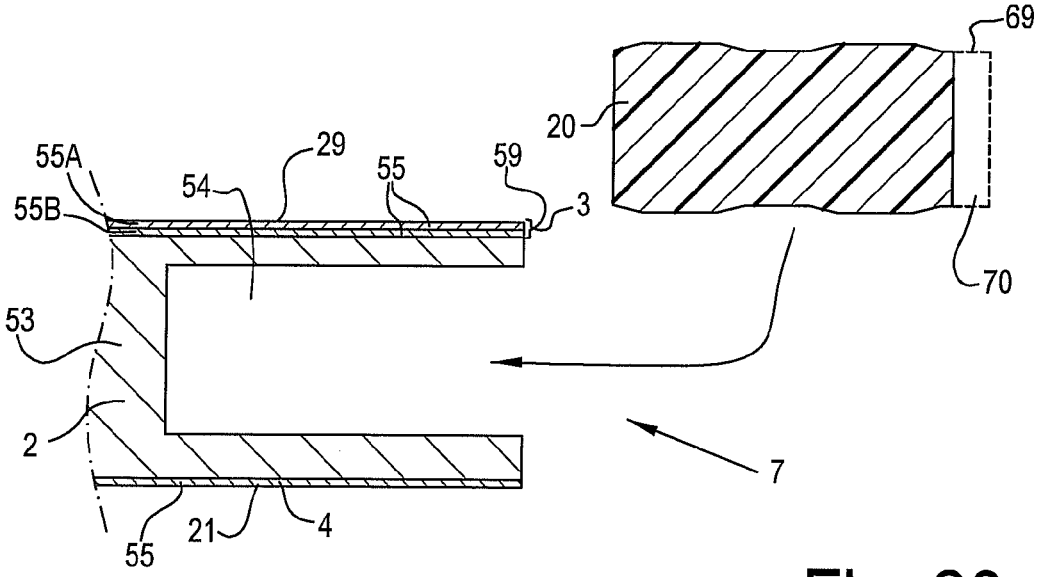
FIGS. 23 and 24 represent views according to the lines XXIII-XXIII and XXIV-XXIV, respectively, indicated in FIG. 22.
Figure 24:
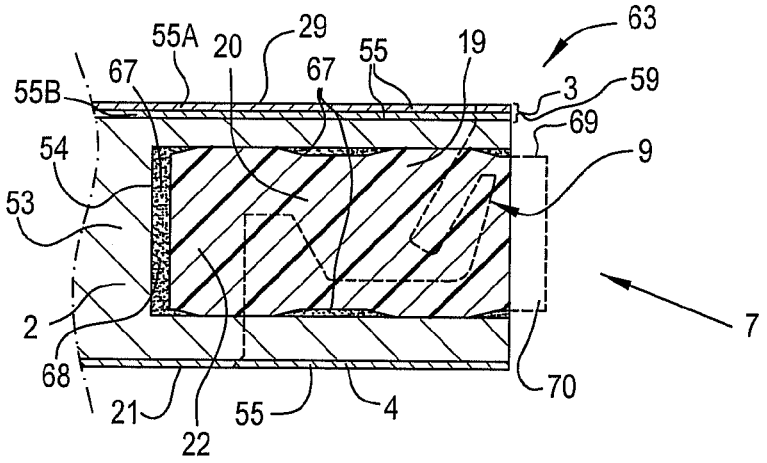

FIGS. 22 through 24 illustrate another method with the characteristics of the sixth aspect. Herein, this relates to a method wherein, for producing the semi-finished product 63, one starts from a board-shaped material 53, upon which the decorative element 59 already has been applied as a top layer 3. In this example, a groove-shaped recess 54 is provided in the actual substrate 2 or board material 53 by means of a machining treatment. The separate edge portion 19, in which the machining treatment of the sixth aspect is performed, is provided at this board-shaped material 53, which already is provided with a top layer 3, by providing it as an insert 20 in the groove-shaped recess 54. The separate edge portion 19 is attached there, for example, by means of gluing.

Thereafter, as described by means of FIG. 21, follows the step of performing a machining treatment. It is noted that such method is recommended for laminate floor panels, such as, for example, the laminate floor panel represented in FIG. 11.

In the case of a floor covering having the characteristics of the first, second, third and/or fourth aspects, it is preferred that at least the bendable lip-shaped portion 17 and/or recess 16 mentioned in these aspects has been formed by means of said machining treatment.

It is evident from FIG. 24 that chambers 67 may be present between the aforementioned separate edge portion 19 or insert 20 and the substrate 2. These chambers 67 may be applied for providing glue 68 therein. Also, on the figure is represented in dashed line 69 that the insert 20 does not necessarily have to be provided completely matching into the actual substrate 2. The excess material 70 is removed, for example, by said machining treatment when forming the coupling parts 9-10 and/or the locking portions 11-12-13-14.

Figure 25:
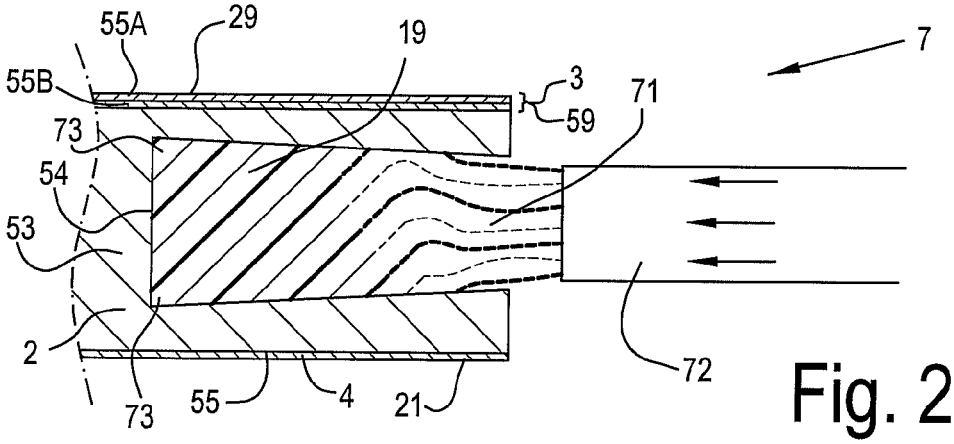
FIGS. 25 and 26 represent variants of a method according to the sixth aspect of the invention in a view similar to that of FIG. 23.

FIG. 25 illustrates a method with the characteristics of the sixth aspect, wherein, when providing the semi-finished product 63, the aforementioned separate edge portion 19 is realized at least partially by providing a solidifying substance 71 at the respective side. In the example of FIG. 25, the separate edge portion 19 is applied by spraying said substance 71 by means of a spraying head 72. It is noted that the here applied, previously made, groove-shaped recess 54, in which the separate edge portion 19 is provided, has an undercut. This undercut 73 promotes the adherence between the separate edge portion 19 of synthetic material and the remainder of the floor element 1. Possibly, by means of the solidifying substance 71 also at least a partial encapsulation may be obtained, wherein then by means of this substance a bottom is provided at the floor element 1, as well as, at least at one side and preferably at all sides, a separate edge portion is formed of the respective material.

Figure 26:
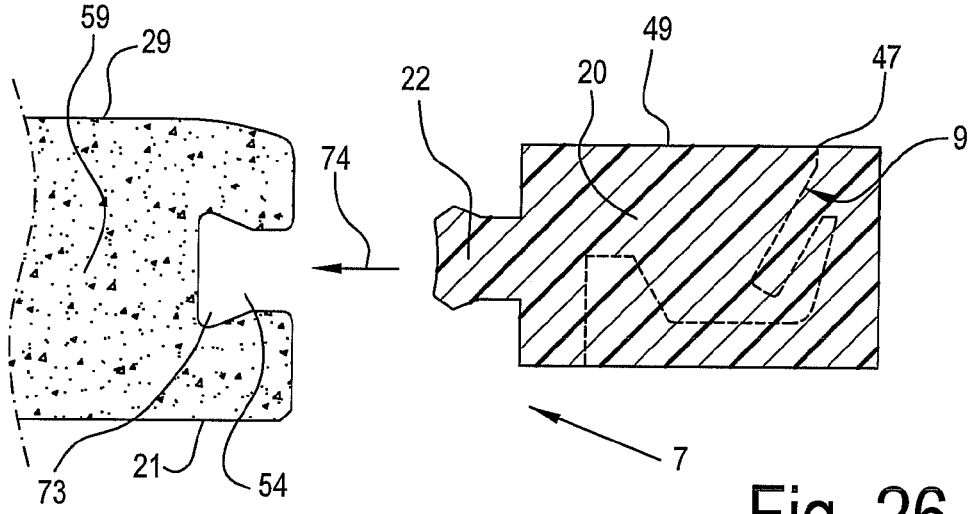

FIG. 26 illustrates another variant of a method with the characteristics of the sixth aspect, wherein said semi-finished product 63 substantially is formed of tile or the like of a stone-like material functioning as the decorative element 59, at which then, directly or indirectly, said separate edge portion 19 is provided at least at one of the sides. In the example of FIG. 26, the separate edge portion 19 is provided by pushing it into the groove-shaped recess 54, as represented by arrow 74, where it is locked by means of a snap-on coupling. Here, too, for obtaining the separate edge portion 19 one may think of an at least partial encapsulation of the decorative clement 59.

Of course, in the example of FIG. 25 as well as in the example of FIG. 26, after the step of providing the semi-finished product 63 follows the step of performing the machining treatment, as schematically represented in FIG. 21.

Figure 27:
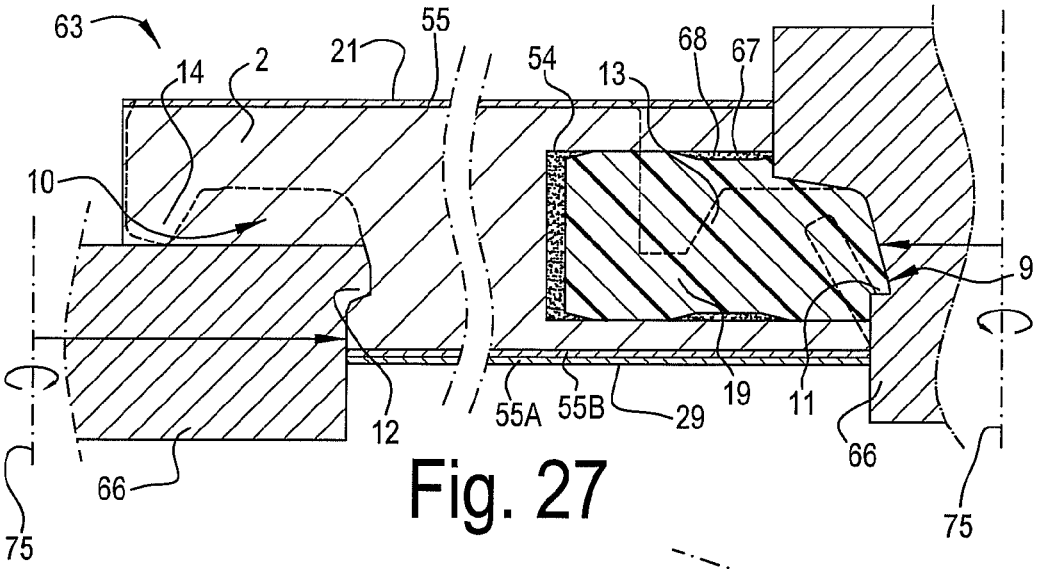
FIGS. 27 to 29 further illustrate how a method with the characteristics of the sixth aspect can be performed.
Figure 28:
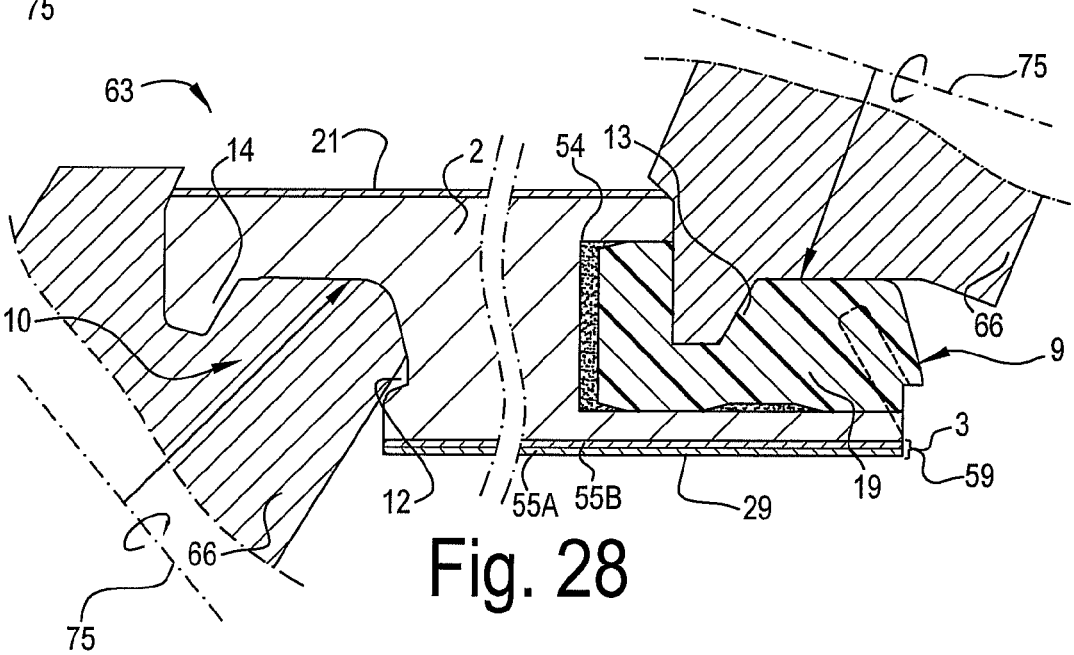
Figure 29:
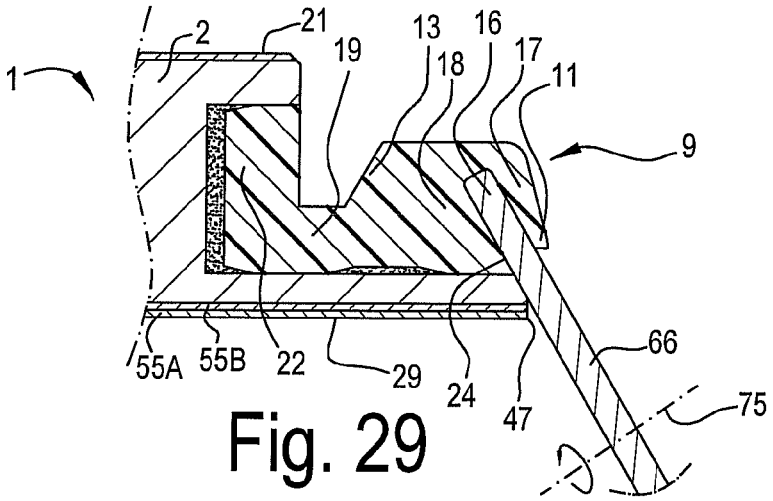

FIGS. 27 to 29 show an example of such machining treatment to greater detail. The figures illustrate how the coupling parts 9-10 and locking portions 11-12-13-14 can be formed in successive machining treatment by means of rotating milling tools 66, while the floor elements are resting on their upper surface 29. The represented floor element 1 is a floor element 1 that can be applied for forming a floor covering 23 with the characteristics of the first through the fourth aspect.

In the step of performing the milling treatment, preferably milling tools 66 are used having a diameter of at least 5 times the thickness of the floor elements 1. In the example of the FIGS. 27 to 29, the milling tools 66 forming the male coupling part 9, as well as the milling tools 66 forming the female coupling part 10, rotate about rotation axes 75 forming at least two different angles with the upper surface 29.

FIG. 29 shows how, amongst others, in the first aspect said recess 16 may be formed by means of a rotating machining tool 66. It is noted that herein, a proximal flank 24 of the recess 16, said flank being inclined according to the third aspect, the extension of which extends beyond the upper edge 47 or just touches it, guarantees a good accessibility for the respective tool 66.

It is noted that floor elements 1 of floor coverings 23 with the characteristics of the first, second, third, fourth, fifth and/or seventh aspects at the respective sides 7-8 preferably may be removed from a floor covering 23 or can be uncoupled again, without requiring a tool to this aim and without thereby damaging the respective coupling parts 9-0, such that they can be used several times. In the most practical forms of embodiment, the coupling parts and locking portions to this aim are made such that two of such floor elements can be uncoupled from each other by means of a turning movement, which applies to all embodiments represented in the figures.

It is not excluded that, according to all herein above-mentioned aspects, the separate edge portion 19 is realized of a natural elastic material, such as natural rubber.

Further, it is noted that according to all aspects of the invention, it is not excluded that said synthetic material also comprises other ingredients, such as ground wood particles, however, that preferably an excess of synthetic material is provided, such that said bending ability of the first lip-shaped portion 17 can be realized. So, for example, a modified wood fiber material may be used, which comprises an excess of resin. Other highly suitable examples of such materials relate to the materials known as "fiber-filled synthetic material composites", or more particularly "extruded wood". Such materials are formed starting from a mixture of ground wood particles, such as fine wood chips and/or wood fibers, and synthetic material and, by means of an extrusion procedure, are formed to a solid material that is simple to process. Apart from the simple processing ability of these composite materials, they also may approach real wood or other wood-based materials in respect to appearance and/or touch, which renders such edge portion in a floor clement more easily acceptable to the user. Apart from wood fibers, also the use of hemp fibers is possible, which show very good fiber geometry for such application. In the case of said filled synthetic material composite, viewed in cross-section, zones with different composition and/or features may be applied in order to obtain different features in different zones, for example, in respect to elasticity, color, adherence, smoothness of the surface, processability and the like. In a practical manner, this may be realized, amongst others, by means of co-extrusion. So, for example, the mixing ratio between synthetic material and filling material, for example, fiber material, such as wood fibers, may be adapted in the respective filled synthetic material composite according to the zone.

From the above, it becomes clear that the present invention, according to a particular independent aspect thereof, also relates to a floor covering 23 consisting of floor elements 1, which, at least at a first pair of two opposite sides 7-8, comprise coupling parts 9-10, which substantially are made as a male coupling part 9 and a female coupling part 10, which are provided with vertically active locking portions 11-12, which, when the coupling parts 9-10 of two of such floor elements 1 cooperate, effect a locking in the vertical direction VI, perpendicular to the plane of the floor elements 1, as well as are provided with horizontally active locking portions 13-14, which, when the coupling parts 9-10 of two of such floor elements 1 cooperate, effect a locking in the horizontal direction H1, perpendicular to respective sides 7-8 and in the plane of the floor covering 23, with as a characteristic that the floor elements 1 comprise at least a substrate 2 and preferably also a top layer 3, wherein at least one of said coupling parts at least partially is formed at a separate edge portion 19-20, preferably an insert 20, which is present at the respective side 7 in the substrate 2, wherein this separate edge portion 19 consists of a filled, preferably a fiber-filled, synthetic material composite, whereas the actual substrate 2 of the floor element 1 substantially consists of one or more other materials. It is evident that advantages may already be achieved when only a portion of one coupling part is made of a filled synthetic material composite, however, that it is preferred that the entire respective coupling part is made of such filled synthetic material composite, and that even better the male as well as the female coupling part are constructed of such material, or anyhow are constructed at least for a part thereof of such material.

Preferably, said fiber-filled synthetic material composite is extruded wood, wherein the filling material is formed by wood chips and/or wood fibers. It is clear that also other filling materials and/or synthetic materials can be applied. For other possible synthetic material composites, reference is made to the introduction, where such materials and their components are explained in connection with the seventh aspect.

For the actual substrate 2, use can be made of any, preferably wood-based material, for example softwood, such as spruce wood, chipboard, fiberboard, MDF or HDF.

The application of this particular independent aspect is particularly interesting for the floor panels known under the denomination of "engineered wood" and of which the substrate 2 is composed of laths 6. So, for example, may this aspect be applied in the embodiments represented in FIGS. 1 to 4, wherein then, for example, the respective separate edge portions are made in said filled synthetic material composite. Such separate edge portions of filled synthetic material, preferably fiber-filled synthetic material, may also be applied in laminate floor panels, such as the one represented in FIG. 11.

This particular independent aspect best may be applied with oblong rectangular floor panels having a pair of long and a pair of short opposite sides. Herein, said separate edge portion of filled synthetic material composite preferably is provided at least at one of the sides of the short pair and still better at least at both opposite short sides. Clearly, it is not excluded that such separate edge portion is also or solely applied at one or both opposite long sides.

Further, it is clear that applying a filled synthetic material composite, such as extruded wood, is useful for providing coupling parts, independently of which type of mutual connection these coupling parts are allowing. So, for example, by means of such extruded wood, one or more coupling parts may be provided at a floor panel, said coupling parts allowing at least for a mutual connection with the coupling parts of another similar floor panel by means of a turning movement, a horizontal shifting movement and/or a downward pushing movement. The composition of filled synthetic materials can be adapted such that they allow forming the most complex profiles therein, for example, by means of a machining treatment, such as milling. Possibly, the respective profiles also may be formed entirely or partially by means of the extrusion process. In the most suitable composition of such filled synthetic material, an excess of synthetic material is applied, which means that a synthetic material/filling material ratio is applied, which is higher than 50:50. Of course, the invention does not exclude that an excess of the filling material, for example, of wood fibers and/or wood chips, might be applied. Further, possibly also the fiber length of the filling material can be adapted, for example, between 70 and 2500 micron. Also, the moisture percentage of the extruded wood may be adapted, for example, between 1 and 10%. Preferably, within the frame of the present invention wood fiber lengths between 100 and 1000 micron and/or moisture percentages lower than 7%, and still better lower than 5%, are handled. These adaptations of mixing ratio, fiber length and/or moisture content are also useful with said seventh aspect of the invention, as well as in all other aspects where such filled synthetic material can be applied.

Of course, floor panels with the characteristics of this particular aspect also may show the characteristics of the first, second, third, fourth and/or seventh aspects. A method according to the sixth aspect, as, for example, illustrated in FIGS. 21 to 25, is recommended for the fabrication of the floor elements which can be applied for composing a floor covering with the characteristics of this particular independent aspect and/or the seventh aspect.

Figure 30:
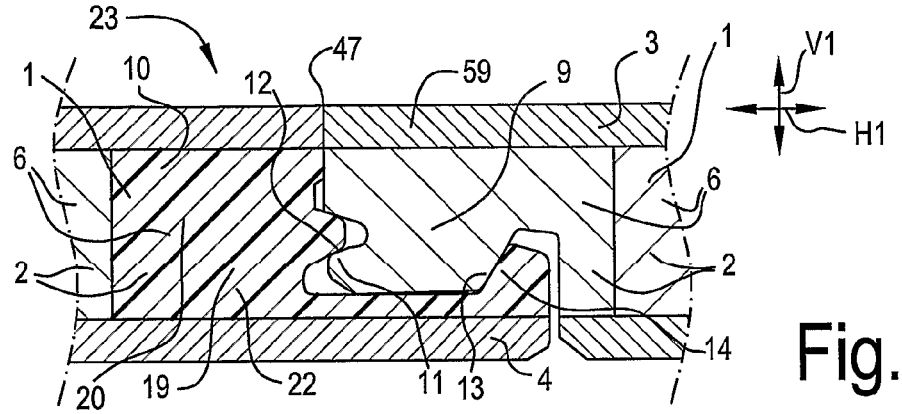
FIGS. 30 to 33, in a view similar to that of FIGS. 8 to 13, represent examples of floor coverings showing, amongst others, the characteristics of the seventh aspect of the invention.

FIG. 30 shows an example of a floor covering, which, amongst others, has the characteristics of said particular aspect of the invention and also shows the characteristics of said seventh aspect, and which is composed of floor elements 1 of the type "engineered wood". The male coupling part 9 can be pushed, with a substantially downward movement, home into the female coupling part 10 in order to form a connection in horizontal direction H1 as well as in vertical direction V1. Herein, the female coupling part 10 of a so-called "push-lock" connection is made in a filled synthetic material, such as extruded wood. To this aim, at the respective side 8 of the floor element 1 a separate edge portion 19 in the form of an insert 20 of this filled synthetic material composite is provided, upon which the female coupling part 10 then is formed entirely, for example, by means of a method with the characteristics of the sixth aspect. The respective insert 20 forms the entire respective side 8 of the floor element 1, with the exception of the top layer 3 and the backing layer 4. The actual substrate 2 is composed of laths 6 of another material, for example, of softwood.

Figure 31:
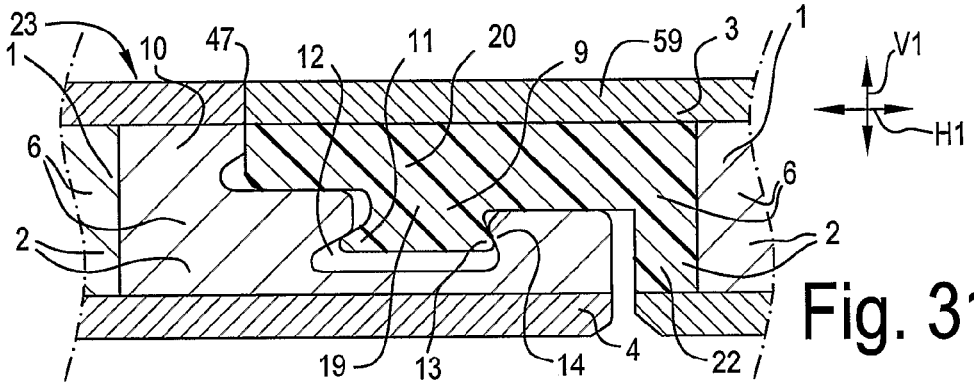
Figure 32:
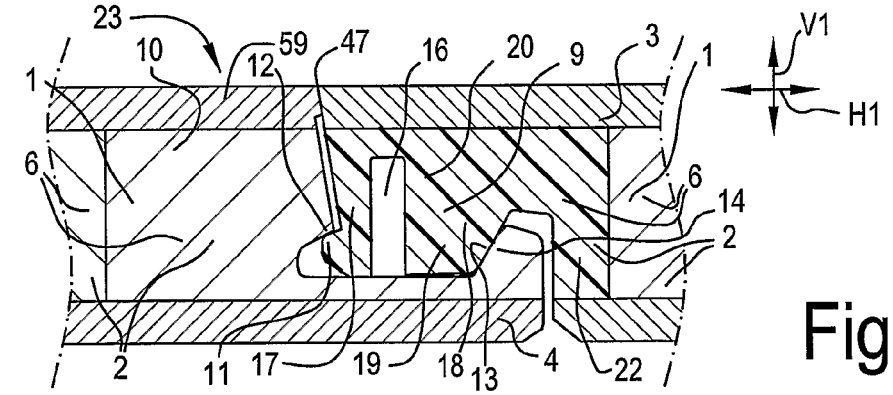
Figure 33:
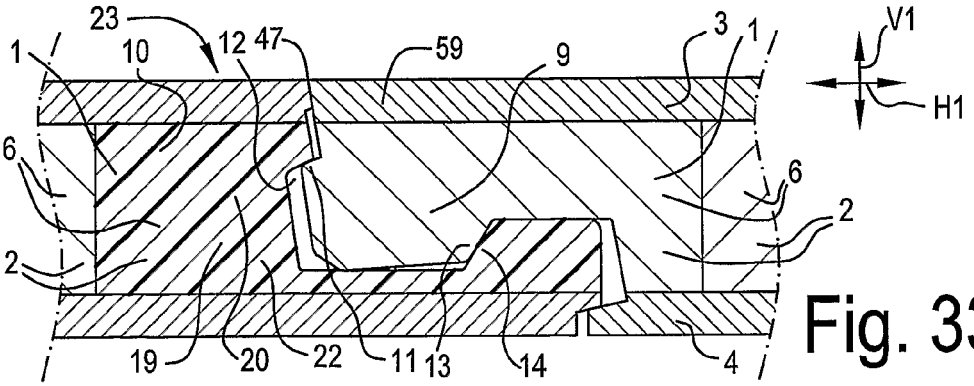

FIGS. 31 and 32 represent other examples, wherein this time the male coupling part 9 is made of a fiber-filled synthetic material composite. FIG. 33 in its turn represents an example where the female coupling part 10 is provided on such insert 20.

FIG. 32 shows the female coupling part 10 as having a projecting end part 101 formed by the substrate 2. The projecting end part 101 comprises the horizontally active locking portion 14, and the horizontally active locking portion 14 is thus also formed by the substrate 2. The horizontally active locking portion 14 comprises a horizontally active locking surface 102 which is under an angle respect to the horizontal direction H1.

It is clear that in all preceding examples of separate edge portions of synthetic material or fiber-filled synthetic material composite, such edge portion may also be provided at two opposite sides, such that the male as well as the female coupling part are made at least partially or entirely on such edge portion.

In respect to all aspects of the invention, it is also noted that in the cases where a separate edge portion or insert of synthetic material forms an entire side of the respective floor element, possibly with the exception of the top layer and/or the backing layer, a water-tight protection of the actual substrate may be obtained at the side concerned. Of course, in order to obtain an entire water-tight protection, it is desirable to provide protective provisions at all edges of the respective floor element, whether or not in the form of such separate edge portion or insert.

In the forms of embodiment or aspects in which a backing layer is mentioned, it is clear that such backing layer is solely optional. In particular, it may be omitted in floor elements of the type "engineered wood" in order to form a floor element, such as "dual layer parquet".

Further, it is noted that according to the invention filled synthetic material composites differ from materials such as MDF, HDF and chipboard in that they have a higher content of synthetic material. This content of synthetic material preferably is higher than 10 percent, and still better higher than 20 percent. By this high content of synthetic material, it can be obtained that the matrix of these filled synthetic materials is formed by the respective synthetic material.

According to all aspects, also cavities may be provided in the synthetic material or filled synthetic composite material, by which, for example, an economization of material can be obtained and/or the mechanical features of the obtained edge portion or any other portion may be influenced.

In particular, in respect to wood fiber-filled and/or wood chip-filled synthetic material composites, such as extruded wood, it is noted additionally that they also may show the following advantageous features, which can be usefully applied in flooring applications. Such materials may be resistant against splitting, deformation and/or splintering; they may be treated with the milling tools that are applied, for example, for treating MDF; these materials may be made anti-bacterial, waterproof and/or moisture-proof; they may be made in different colors, amongst which, the color of wood; when touched, they may feel like traditional wood; they may be made recyclable and/or maintenance-friendly.

The present invention is in no way limited to the forms of embodiment described as an example and represented in the figures; on the contrary, such floor coverings, floor panels and methods may be realized according to various variants, without leaving the scope of the invention.

It is clear that the terms "floor covering" and "floor elements" are to be understood in the broadest sense. They relate to any coverings or elements that can be applied as floor coverings or floor elements, even if they are not commercialized to this aim.

The invention claimed is:

1. A floor element for forming a floor covering, comprising:

a first pair of opposite sides, including first and second opposite sides, comprising a first coupling part on the first opposite side, and a second coupling part on the second opposite side, wherein the first coupling part comprises a male coupling part and the second coupling part comprises a female coupling part, and wherein the first coupling part and the second coupling part are provided with vertically active locking portions, arranged such that, the first and second coupling parts cooperate with corresponding coupling parts of another floor element and, as coupled to the another floor element, effect a locking in a vertical direction, perpendicular to a plane of the floor covering, wherein the first coupling part and the second coupling part comprise horizontally active locking portions, arranged such that the first and second coupling parts cooperate with the corresponding coupling parts of the another floor element and, as coupled to the another floor element, effect a locking in a horizontal direction, perpendicular to the first pair of opposite sides and in the plane of the floor covering, wherein the first and second coupling parts are arranged such that the floor element is configured to couple to the corresponding coupling parts of the another floor element by a horizontal shifting movement and a downward movement;

wherein the floor element comprises a substrate and a top layer, and wherein the substrate is made of a filled synthetic material composite and the first and second coupling parts are formed in the substrate, such that both of the vertically active locking portions and the horizontally active locking portions are entirely made of the filled synthetic material composite, and wherein the top layer comprises a decorative film with a printed decor;

wherein the filled synthetic material composite comprises a thermoplastic material and an inorganic filling material;

wherein a weight ratio between the thermoplastic material and the inorganic filling material is between 50:50 and 10:90; and wherein the first and second coupling parts are milled profiles.

2. The floor element of claim 1, wherein the thermoplastic material is selected from polyethylene, polypropylene and polyvinylchloride.

3. The floor element of claim 1, wherein floor element is rectangular and the first pair of opposite sides is located on a first pair of short sides of the floor element and a second pair of opposite sides, including third and fourth opposite sides, is located on a first pair of long sides of the floor element;

and wherein the third opposite side comprises a third coupling part and the other fourth opposite side comprises a fourth coupling part;

wherein the third coupling part comprises a male coupling part and the fourth coupling part comprises a female coupling part, and wherein the third coupling part and the fourth coupling part are provided with vertically active locking portions, arranged such that the third and fourth coupling parts cooperate with corresponding coupling parts of another floor element and, as coupled to the another floor element, effect a locking in a vertical direction, perpendicular to a plane of the floor covering, wherein the third coupling part and the fourth coupling part comprise horizontally active locking portions, arranged such that the third and fourth coupling parts cooperate with the corresponding coupling parts of the another floor element and, as coupled to the another floor element, effect a locking in a horizontal direction, perpendicular to the second pair of opposite sides and in the plane of the floor covering.

4. The floor element of claim 1, wherein the male coupling part for the first coupling part comprises a tongue and the female coupling part for the second coupling part comprises a groove delimited by a lower lip and an upper lip, wherein the horizontally active locking portions comprise an upright locking element on the lower lip and, interacting therewith, a downward directed locking element on an underside of the tongue.

5. The floor element of claim 4, wherein the lower lip projects beyond an upper edge at the respective side and comprises a bendable portion, and wherein the first and second coupling parts are configured to couple to the corresponding coupling parts of the another floor element by a snap-on action.

6. The floor element of claim 5, wherein the bendable portion is configured to be capable of deforming and is at least partially relaxed at an end of the snap-on action.

7. The floor element of claim 1, wherein said downward movement has a vertical component and a horizontal component.

8. A floor element for forming a floor covering, comprising:

a first pair of opposite sides, including first and second opposite sides, comprising a first coupling part on the first opposite side, and a second coupling part on the the second opposite side, wherein the first coupling part comprises a male coupling part and the second coupling part comprises a female coupling part, and wherein the first coupling part and the second coupling part are provided with vertically active locking portions arranged such that the first and second coupling parts cooperate with the corresponding coupling parts of another floor element and, as coupled to the another floor element, effect a locking in a vertical direction, perpendicular to a plane of the floor covering, wherein the first coupling part and the second coupling part comprise horizontally active locking portions arranged such that the first and second coupling parts cooperate with the corresponding coupling parts of the another floor element and, as coupled to the another floor element, effect a locking in a horizontal direction, perpendicular to the first pair of opposite sides and in the plane of the floor covering, wherein the male coupling part for the first coupling part comprises a tongue and the female coupling part for the second coupling part comprises a groove delimited by a lower lip and an upper lip, wherein the horizontally active locking portions comprise an upright locking element on the lower lip and, interacting therewith, a downward directed locking element on an underside of the tongue, wherein the first and the second coupling parts are arranged such that the floor element is configured to couple to the corresponding coupling parts of the another floor element by a downward movement, said downward movement comprising a horizontal component and a vertical component;

wherein the floor element comprises a substrate and a top layer, wherein the substrate made of a filled synthetic material composite and the first and second coupling parts are formed in the substrate, such that both of the vertically active locking portions and the horizontally active locking portions are entirely made of the filled synthetic material composite, and wherein the top layer comprises a decorative film with a printed decor;

wherein the filled synthetic material composite comprises a thermoplastic material and an inorganic filling material;

wherein a weight ratio between the thermoplastic material and the inorganic filling material is lower than 50:50;

wherein the first and second coupling parts are milled profiles; and wherein the thermoplastic material is selected from polyethylene, polypropylene and polyvinylchloride.

9. The floor element of claim 8, wherein the filled synthetic material composite has a content of thermoplastic material greater than 10 percent.

10. The floor element of claim 8, wherein the filled synthetic material composite has a content of thermoplastic material greater than 20 percent.

11. The floor element of claim 8, wherein the male coupling part for the first coupling part comprises a tongue and the female coupling part for the second coupling part comprises a groove delimited by a lower lip and an upper lip, wherein the horizontally active locking portions comprise an upright locking element on the lower lip and, interacting therewith, a downward directed locking element on an underside of the tongue.

12. The floor element of claim 11, wherein the lower lip projects beyond an upper edge at the respective side and comprises a bendable portion, and wherein the first and second coupling parts are configured to couple to the corresponding coupling parts of the another floor element by a snap-on action.

13. A floor element for forming a floor covering, comprising:

a first pair of opposite sides, including first and second opposite sides, comprising a first coupling part on the first opposite side, and a second coupling part on the second opposite side, wherein the first coupling part comprises a male coupling part and the second coupling part comprises a female coupling part, and wherein the first coupling part and the second coupling part are provided with vertically active locking portions, arranged such that the first and second coupling parts cooperate with the corresponding coupling parts of another floor element and, as coupled to the another floor element, effect a locking in a vertical direction, perpendicular to a plane of the floor covering, wherein the first coupling part and the second coupling part comprise horizontally active locking portions arranged such that the first and second coupling parts cooperate with the corresponding coupling parts of the another floor element and, as coupled to the another floor element, effect a locking in a horizontal direction, perpendicular to the first pair of opposite sides and in the plane of the floor covering, wherein the male coupling part for the first coupling part comprises a tongue and the female coupling part for the second coupling part comprises a groove delimited by a lower lip and an upper lip, wherein the horizontally active locking portions comprise an upright locking element on the lower lip and, interacting therewith, a downward directed locking element on an underside of the tongue, wherein the first and second coupling parts are arranged such that the floor element is configured to couple to the corresponding coupling parts of the another floor element by a horizontal shifting movement or a downward movement;

wherein the female coupling part comprises a bendable portion formed at least by a portion of the female coupling part projecting beyond an upper edge at the respective side;

wherein the first and second coupling parts are arranged such that the floor element is configured to couple to the corresponding coupling parts of the another floor element by a snap-on action;

wherein the floor element comprises a substrate and a top layer, wherein the substrate made of a filled synthetic material composite and the first and second coupling parts are formed in the substrate, such that both of the vertically active locking portions and the horizontally active locking portions are entirely made of the filled synthetic material composite, and wherein the top layer comprises a decorative film with a printed decor;

wherein the filled synthetic material composite comprises a thermoplastic material and an inorganic filling material;

wherein a weight ratio between the thermoplastic material and the inorganic filling material is lower than 50:50;

wherein the first and second coupling parts are milled profiles; and wherein the thermoplastic material is selected from polyethylene, polypropylene and polyvinylchloride.

14. The floor element of claim 13, wherein said downward movement has a vertical component and a horizontal component.

15. The floor element of claim 14, wherein the horizontal component dominates.

16. The floor element of claim 14, wherein the filled synthetic material composite has a content of thermoplastic material greater than 10 percent.

17. The floor element of claim 16, wherein the milled profiles are made with a milling process using rotating milling tools.

18. The floor element of claim 13, wherein the filled synthetic material composite has a content of thermoplastic material greater than 20 percent.

19. The floor element of claim 13, wherein the substrate comprises an upper side and an under side facing downward toward the floor, the upper side provided with the top layer, wherein the floor element comprises a backing layer on the underside, wherein the filled synthetic material composite is between the backing layer and the top layer.

20. The floor element of claim 13, wherein the filled synthetic material composite is an extruded filled synthetic material composite.

* * * * *